US008480444B2

(12) United States Patent
Mataya

(10) Patent No.: US 8,480,444 B2
(45) Date of Patent: Jul. 9, 2013

(54) ROTARY ENGINE JET BOAT

(75) Inventor: Robert F. Mataya, Nixa, MO (US)

(73) Assignee: Tracker Marine, L.L.C., Springfield, MO (US)

( * ) Notice: Subject to any disclaimer, the term of this patent is extended or adjusted under 35 U.S.C. 154(b) by 507 days.

(21) Appl. No.: 12/580,143

(22) Filed: Oct. 15, 2009

(65) Prior Publication Data

US 2011/0092113 A1 Apr. 21, 2011

(51) Int. Cl.
*B63H 11/02* (2006.01)

(52) U.S. Cl.
USPC ..... 440/38; 440/89 E; 440/89 R; 114/291

(58) Field of Classification Search
USPC ..... D12/313, 314; 440/38, 46, 47, 89 R–89 J; 114/271, 291, 67 A, 183 R, 197, 198; 181/235
See application file for complete search history.

(56) References Cited

U.S. PATENT DOCUMENTS

| | | | | |
|---|---|---|---|---|
| 3,308,793 | A | 3/1967 | Ito | |
| 3,369,528 | A | 2/1968 | Irgens | |
| 3,483,694 | A | 12/1969 | Huber et al. | |
| 3,552,121 | A | 1/1971 | Kitagawa et al. | |
| 3,785,327 | A | 1/1974 | Smith | |
| 3,830,599 | A | 8/1974 | Poehlman | |
| 3,908,607 | A | 9/1975 | Van Rens | |
| 4,002,136 | A | 1/1977 | Michalak | 440/89 R |
| 4,059,371 | A | 11/1977 | Sheldon | |
| 4,229,151 | A | 10/1980 | Van Rens | |
| 5,024,590 | A | 6/1991 | Adiwinata | |
| 5,067,883 | A | 11/1991 | Adiwinata | |
| 5,168,846 | A | 12/1992 | Paul et al. | |
| 5,234,364 | A * | 8/1993 | Ito | 440/89 R |
| 5,240,443 | A * | 8/1993 | Futaki | 440/38 |
| 5,310,325 | A | 5/1994 | Gulyash | |
| 5,357,913 | A | 10/1994 | Okumura et al. | 123/184.34 |
| 5,375,987 | A | 12/1994 | Brent | |
| 5,607,332 | A * | 3/1997 | Kobayashi et al. | 440/41 |
| 5,713,293 | A * | 2/1998 | Shiffler et al. | 114/61.27 |
| 5,720,636 | A | 2/1998 | Burg | |
| 5,787,829 | A * | 8/1998 | Oshima | 114/67 A |
| 6,058,873 | A * | 5/2000 | Koyanagi | 114/291 |
| 6,138,601 | A * | 10/2000 | Anderson et al. | 114/285 |
| 6,412,434 | B1 * | 7/2002 | Kaneko | 114/271 |

(Continued)

FOREIGN PATENT DOCUMENTS

JP 62-238192 10/1987

OTHER PUBLICATIONS

1825 Rebel XL Vazer. [online]. Lund Boats, 2009 [retrieved on Oct. 14, 2009]. Retrieved from the Internet: <URL: www.lundboats.com/2009_1825_rebel_xl_vazer.html>.

(Continued)

*Primary Examiner* — Edwin Swinehart
(74) *Attorney, Agent, or Firm* — Pillsbury Winthrop Shaw Pittman, LLP

(57) ABSTRACT

A boat includes a hull, an inboard rotary engine, and a jet propulsion unit connected to the engine via a direct drive connection. The hull may be a stepped hull with one or more aft steps. A large, low, substantially flat aft fishing/swim deck is disposed above the engine and an exhaust system of the engine. The exhaust system may vent into the step of the stepped hull and include a check valve that discourages water from backflowing into the engine.

25 Claims, 14 Drawing Sheets

U.S. PATENT DOCUMENTS

| | | | | |
|---|---|---|---|---|
| 6,428,369 | B1 * | 8/2002 | Jones | 440/38 |
| 6,439,939 | B1 * | 8/2002 | Jaeger | 440/88 R |
| 6,892,692 | B2 | 5/2005 | Barrett | |
| 6,948,990 | B2 * | 9/2005 | Hattori | 440/88 A |
| 7,182,659 | B2 * | 2/2007 | Noda et al. | 440/89 E |
| 7,252,567 | B2 | 8/2007 | Roos | |
| 7,275,919 | B2 | 10/2007 | Atkins | |
| 7,281,513 | B1 | 10/2007 | Webb | |
| 7,303,380 | B1 | 12/2007 | Atkins | |
| 7,669,542 | B2 | 3/2010 | Donahue et al. | 114/361 |
| 2005/0188943 | A1 | 9/2005 | Gonzalez et al. | |
| 2007/0157866 | A1 | 7/2007 | Mataya | |
| 2008/0141924 | A1 | 6/2008 | Adams | 114/343 |
| 2009/0007882 | A1 | 1/2009 | Lents et al. | |

OTHER PUBLICATIONS

Mazda 1979 RX-7 (SA). [online]. [retrieved on Oct. 14, 2009]. Retrieved from the Internet: <URL: http://home.online.no/~arban/RX7.html>.

Apex Seals. [online]. AtkinsRotary.com, 2004 [retrieved on Oct. 14, 2009]. Retrieved from the Internet: <URL: http://xcart.web.aplus.net/store/product.php?productid=16575&cat=631&page=1>.

Solid Corner Seals. [online]. AtkinsRotary.com, 2004 [retrieved on Oct. 14, 2009]. Retrieved from the Internet: <URL: http://xcart.web.aplus.net/store/product.php?productid=16191&cat=631&page=1>.

Eccentric Shafts. [online]. AtkinsRotary.com, 2004 [retrieved on Oct. 14, 2009]. Retrieved from the Internet: <URL: http://xcart.web.aplus.net/store/product.php?productid=17006&cat=0&page=1>.

Side Seals. [online]. AtkinsRotary.com, 2004 [retrieved on Oct. 14, 2009]. Retrieved from the Internet: <URL: http://xcartweb.aplus.net/store/product.php?productid=16185&cat=631&page=1>.

Oil Control Rings. [online]. AtkinsRotary.com, 2004 [retrieved on Oct. 14, 2009]. Retrieved from the Internet: <URL: http://xcart.web.aplus.net/store/product.php?productid=16579&cat=631&page=1>.

Oil Control Ring Inserts. [online]. AtkinsRotary.com, 2004 [retrieved on Oct. 14, 2009]. Retrieved from the Internet: <URL: http://xcart.web.aplus.net/store/product.php?productid=16578&cat=631&page=1>.

Water Pump Pulley. [online]. AtkinsRotary.com, 2004 [retrieved on Oct. 14, 2009]. Retrieved from the Internet: <URL: http://xcart.web.aplus.net/store/product.php?productid=16396&cat=0&page=1>.

Main Pulley. [online]. AtkinsRotary.com, 2004 [retrieved on Oct. 14, 2009]. Retrieved from the Internet: <URL: http://xcart.web.aplus.net/store/product.php?productid=16396&cat=0&page=1>.

Alternator Pulley. [online]. AtkinsRotary.com, 2004 [retrieved on Oct. 14, 2009]. Retrieved from the Internet: <URL: http://xcart.web.aplus.net/store/product.php?productid=16396&cat=0&page=1>.

Thermal Pellets. [online]. AtkinsRotary.com, 2004 [retrieved on Oct. 14, 2009]. Retrieved from the Internet: <URL: http://xcart.web.aplus.net/store/product.php?productid=16401&cat=635&page=1>.

Thrust Bearings. [online]. AtkinsRotary.com, 2004 [retrieved on Oct. 14, 2009]. Retrieved from the Internet: <URL: http://xcart.web.aplus.net/store/product.php?productid=16914&cat=0&page=1>.

Tension Bolt Washers. [online]. AtkinsRotary.com, 2004 [retrieved on Oct. 14, 2009]. Retrieved from the Internet: <URL: http://xcart.web.aplus.net/store/product.php?productid=17112&cat=0&page=1>.

Oil Filler Caps. [online]. AtkinsRotary.com, 2004 [retrieved on Oct. 14, 2009]. Retrieved from the Internet: <URL: http://xcart.web.aplus.net/store/search.php?mode=search&page=1>.

One Rotor Oil Pan. [online]. AtkinsRotary.com, 2004 [retrieved on Oct. 14, 2009]. Retrieved from the Internet: <URL: http://xcart.web.aplus.net/store/product.php?productid=17008&cat=309&page=1>.

Tension Bolts. [online]. AtkinsRotary.com, 2004. [retrieved on Oct. 14, 2009]. Retrieved from the Internet: <URL: http://xcart.web.aplus.net/store/product.php?productid=17007&cat=309&page=1>.

Side Mount Alternator Kit. [online]. AtkinsRotary.com, 2004 [retrieved on Oct. 14, 2009]. Retrieved from the Internet: <URL: http://xcart.web.aplus.net/store/product.php?productid=16958&cat=0&page=1>.

Exhaust Flanges. [online]. AtkinsRotary.com, 2004 [retrieved on Oct. 14, 2009]. Retrieved from the Internet: <URL: http://xcart.web.aplus.net/store/product.php?productid=17114&cat=309>.

Exhaust Flanges. [online]. AtkinsRotary.com, 2004 [retrieved on Oct. 14, 2009]. Retrieved from the Internet: <URL: http://xcart.web.aplus.net/store/product.php?productid=17115&cat=673&page=1>.

One Rotor Dowel Pins. [online]. AtkinsRotary.com, 2004 [retrieved on Oct. 14, 2009]. Retrieved from the Internet: <URL: http://xcart.web.aplus.net/store/product.php?productid=17116&cat=309>.

One Rotor Stationary Retainer. [online]. AtkinsRotary.com, 2004 [retrieved on Oct. 14, 2009]. Retrieved from the Internet: <URL: http://xcart.web.aplus.net/store/product.php?productid=17113&cat=309>.

Marine Bell Housing. [online]. AtkinsRotary.com, 2004 [retrieved on Oct. 14, 2009]. Retrieved from the Internet: <URL: http://xcart.web.aplus.net/store/product.php?productid=16761&cat=586&page=1>.

Marine Flywheel—available in steel and aluminum. [online]. AtkinsRotary.com, 2004 [retrieved on Oct. 14, 2009]. Retrieved from the Internet: <URL: http://xcart.web.aplus.net/store/product.php-?productid=16760&cat=586&page=1>.

One Rotor Intake Manifolds. [online]. AtkinsRotary.com, 2004 [retrieved on Oct. 14, 2009]. Retrieved from the Internet: <URL: http://xcart.web.aplus.net/store/product.php?productid=17117&cat=309&page=1>.

Two Rotor Intake Manifolds. [online]. AtkinsRotary.com, 2004 [retrieved on Oct. 14, 2009]. Retrieved from the Internet: <URL: http://xcart.web.aplus.net/store/product.php?productid=16287&cat=663&page=1>.

One Rotor Exhaust Manifolds. [online]. AtkinsRotary.com, 2004 [retrieved on Oct. 14, 2009]. Retrieved from the Internet: <URL: http://xcart.web.aplus.net/store/product.php?productid=17118&cat=309&page=1>.

Two Rotor Exhaust Manifolds. [online]. AtkinsRotary.com, 2004 [retrieved on Oct. 14, 2009]. Retrieved from the Internet: <URL: http://xcart.web.aplus.net/store/product.php?productid=16979&cat=586&page=1>.

Crook. Editorial: Rotary Reborn?, Real World Solutions, Inc. [online], Rotary Aviation News Issue 1, 1997 [retrieved on Jan. 6, 2010]. Retrieved from the Internet <URL: http://www.rotaryaviation.com/Editorials/Rotary_reborn.htm>.

Kelley, "Rotary Rocket: Ebbtide launches its new RX-19 jetboat, powered by a marinized Mazda rotary engine," Trailer Boats, Poole Publications, Inc., vol. 25, No. 5, May 1996, pp. 58-60 (4 pages).

* cited by examiner

ROTARY ENGINE JET BOAT

BACKGROUND OF THE INVENTION

1. Field of the Invention

The present invention relates generally to boats that use a jet propulsion unit.

2. Description of Related Art

A bass boat is a small boat that is designed and equipped primarily for bass fishing or fishing for other panfish, usually in freshwater such as lakes, rivers, and streams. Bass boats are typically powered by an outboard engine and include large flat decks or fishing platforms that facilitate standing on the deck and fishing from a variety of positions and angles on the boat.

Jet propulsion boats produce a propulsion force that is generated by expelling or ejecting water rearwardly from the back of the boat. The jet propulsion boat generally draws water from under the boat into a jet pump disposed in the boat. The water then passes through a series of impellers and stators which increase the velocity of the water flow. The jet pump then discharges the water at a high velocity rearwardly through a nozzle at the stern to generate the propulsion force that pushes the boat forward.

SUMMARY OF EMBODIMENTS OF THE INVENTION

One or more embodiments of the present invention provides a boat with a hull; an inboard rotary engine supported by the hull, the engine having a drive shaft; a jet propulsion unit supported by the hull; and a direct drive connection between the drive shaft and the jet propulsion unit.

The hull may include a stepped hull that includes a transom, a planing bottom surface, a stepped bottom surface that is upwardly offset from the planing bottom surface, the stepped bottom surface being disposed between the planing bottom surface and the transom, and a connecting surface extending between the planing bottom surface and the stepped bottom surface.

The boat may include an exhaust port extending through the stepped bottom surface, and an exhaust passageway fluidly connecting an exhaust outlet of the engine to the exhaust port. A check valve may be disposed in the exhaust passageway and oriented so as to discourage water from entering the engine via the exhaust port.

According to one or more embodiments, the boat includes a floating valve seal in a portion of the exhaust passageway that extends at least partially vertically. The floating valve seal is moveable between an upward sealing position and a lower unsealed position. The floating valve seal is configured to move into the upward sealing position in response to a water level in the portion of the exhaust passageway rising. The floating valve seal discourages water from entering the engine via the exhaust port when the floating valve seal is in the upward sealing position.

According to various embodiments, the hull is at least 10, 12, or 14 feet long and/or may be less than 30 feet long.

According to one or more embodiments, the exhaust passageway has a water ingress height defined as a height of water within the exhaust passageway at which water would backflow into the engine. The water ingress height may be less than 30, 28, and/or 25 inches above a bottom of the hull.

According to one or more embodiments, the boat has a waterline defined when the boat is fully fueled and ready for operation, but is unmanned. The water ingress height is less than 11, 10, and/or 9 inches above the waterline.

According to one or more embodiments, the boat has a cockpit having a steering wheel and separate throttle controller. According to one or more embodiments, the boat comprises side-by-side seats.

According to one or more embodiments, the boat includes an exhaust port extending through the hull to an outer surface of the hull that is below a waterline of the boat defined when the boat is fully fueled and ready for operation, but is unmanned; an exhaust passageway fluidly connecting an exhaust outlet of the engine to the exhaust port; and a check valve in the exhaust passageway, the check valve being oriented so as to discourage water from entering the engine via the exhaust port.

According to one or more embodiments, the boat includes an exhaust port extending through the hull to an outer surface of the hull that is below a waterline of the boat defined when the boat is fully fueled and ready for operation, but is unmanned; an exhaust passageway fluidly connecting an exhaust outlet of the engine to the exhaust port; and a floating valve seal in a portion of the exhaust passageway that extends at least partially vertically, the floating valve seal being moveable between an upward sealing position and a lower unsealed position, the floating valve seal being configured to move into the upward sealing position in response to a water level in the portion of the exhaust passageway rising, the floating valve seal discouraging water from entering the engine via the exhaust port when the floating valve seal is in the upward sealing position.

According to one or more embodiments, the engine does not connect to the jet propulsion unit via a transmission.

One or more embodiments of the present invention provides a boat with a stepped hull having a transom, a planing bottom surface, a stepped bottom surface that is upwardly offset from the planing bottom surface, the stepped bottom surface being disposed between the planing bottom surface and the transom, and a connecting surface extending between the planing bottom surface and the stepped bottom surface. The boat also includes an inboard rotary engine supported by the hull, and a jet propulsion unit supported by the hull and operatively connected to the engine to propel the boat when driven by the engine.

According to one or more embodiments, the jet propulsion unit has an intake portion that projects downwardly from the stepped bottom surface such that a bottom of the intake portion is vertically aligned with the planing bottom surface.

According to one or more embodiments, the hull has a jet propulsion unit mount that projects downwardly from the stepped bottom surface such that a bottom of the jet propulsion unit mount is vertically aligned with the planing bottom surface, and the jet propulsion unit is mounted to the jet propulsion unit mount. According to one or more embodiments, a portion of the jet propulsion unit mount projects rearwardly from the transom.

According to one or more embodiments, the boat has a cockpit having a steering wheel and a throttle controller separate from the steering wheel. The cockpit may have a seat adapted for use by a person driving the boat, the seat having a bottom portion and an upwardly extending back support.

According to one or more embodiments, the hull extends rearwardly farther than any part of the jet propulsion unit.

One or more embodiments of the present invention provides a boat with a hull less than 30 feet long; an aft fishing deck extending across at least 80% of the width of the hull, the deck extending above a bottom of the hull by less than 27 inches; an inboard engine supported by the hull, the engine having a drive shaft; and a propulsion unit supported by the hull and operatively connected to the drive shaft to propel the boat when driven by the drive shaft. The engine is disposed entirely lower than the aft deck.

According to one or more embodiments, the boat further includes an engine exhaust passageway extending from the engine to an exterior exhaust port, and the exhaust passageway is disposed entirely lower than the aft deck.

According to one or more embodiments, the aft deck extends above the waterline by less than 15, 11, or 10 inches.

According to one or more embodiments, the aft deck is vertically separated from a bottom of the hull by less than 28 or 26 inches at any longitudinal point along the aft deck as viewed from the side.

According to one or more embodiments, lateral sides of the hull extend vertically higher than the deck by less than 10 inches at any longitudinal position of the aft deck as viewed from the side.

According to one or more embodiments, the engine exhaust passageway falls entirely within a downwardly projected outer perimeter of the aft deck.

According to one or more embodiments, the engine falls entirely within a downwardly projected outer perimeter of the aft deck.

According to one or more embodiments, the aft deck has a flush-mount engine compartment lid that forms part of the aft deck when closed and provides access to the engine when open.

According to various embodiments, the boat may be a bass boat, a runabout, or another type of boat.

According to one or more embodiments, an area of the aft deck is at least 10 square feet.

According to one or more embodiments, a height of the aft deck does not deviate by more than 2 inches over the course of a foot in any direction.

According to one or more embodiments, the aft deck extends the whole way to the transom. The aft deck may be higher than the transom.

One or more embodiments of the present invention provides a boat with a hull having a length of between 12 and 30 feet; an aft fishing deck that is at least 4 feet wide and 2.5 feet long and has an area of at least 10 square feet; an inboard engine supported by the hull, the engine having a drive shaft; and a propulsion unit supported by the hull and operatively connected to the drive shaft to propel the boat when driven by the drive shaft. The aft deck extends above a bottom of the hull by less than 27 inches.

One or more embodiments of the present invention provides a boat with a hull; an inboard engine supported by the hull, the engine having a drive shaft; a propulsion unit supported by the hull and operatively connected to the drive shaft to propel the boat when driven by the drive shaft; an exhaust port extending through the hull and opening into an ambient environment; and an exhaust passageway fluidly connecting an exhaust outlet of the engine to the exhaust port. The boat is longer than 14 feet. The water ingress height is less than 26 inches above a bottom of the hull.

According to one or more embodiments, the boat includes an aft fishing deck that is disposed higher than the exhaust passageway.

One or more embodiments of the present invention provides a boat with a hull; an inboard engine supported by the hull, the engine having a drive shaft; a jet propulsion unit supported by the hull, the jet propulsion unit having an input shaft operatively connected to the drive shaft to propel the boat when driven by the drive shaft; a male mount having an outer surface, the male mount being connected to one of the engine and the jet propulsion unit; a female mount having an inner surface that is complimentary of the outer surface of the male mount, the female mount being connected to the other of the engine and jet propulsion unit; an elastomeric ring physically interposed between the inner and outer surfaces and providing a structural connection between the male and female mounts so as to form a structural connection between the engine and jet propulsion unit; and a drive train operatively connecting the engine to the jet propulsion unit, the drive train comprising the drive shaft and the input shaft, wherein the drive train extends through the female mount, the male mount, and the elastomeric ring.

According to one or more embodiments, the outer surface tapers inwardly toward its distal end and the inner surface tapers outwardly toward its distal end such that the mounts self align the engine relative to the jet propulsion unit when the male mount is slid into the female mount.

According to one or more embodiments, the engine is mounted to the hull via a three-point connection. A first point of the three point connection is defined by the male and female mounts and the elastomeric ring. Second and third points of the three-point connection are defined by first and second laterally spaced engine mounts extending between the engine and the hull.

According to one or more embodiments, the engine mounts comprise an elastomeric material such that all three points of the three point connection vibrationally dampen the engine relative to the hull.

One or more embodiments of the present invention provides a boat with a hull; an inboard engine supported by the hull, the engine having a drive shaft; a propulsion unit supported by the hull, the propulsion unit having an input shaft operatively connected to the drive shaft to propel the boat when driven by the drive shaft; a male mount having an outer surface, the male mount being connected to one of the engine and the propulsion unit; a female mount having an inner surface that is complimentary of the outer surface of the male mount, the female mount being connected to the other of the engine and propulsion unit; an elastomeric ring physically interposed between the inner and outer surfaces and providing a structural connection between the male and female mounts so as to form a structural connection between the engine and propulsion unit; a drive train operatively connecting the engine to the propulsion unit, the drive train comprising the drive shaft and the input shaft, wherein the drive train extends through the female mount, the male mount, and the elastomeric ring; and a three-point connection that mounts the engine to the hull. A first point of the three point connection is defined by the male and female mounts and the elastomeric ring. Second and third points of the three-point connection are defined by first and second laterally spaced engine mounts extending between the engine and the hull.

These and other aspects of various embodiments of the present invention, as well as the methods of operation and functions of the related elements of structure and the combination of parts and economies of manufacture, will become more apparent, upon consideration of the following description and the appended claims with reference to the accompanying drawings, all of which form a part of this specification, wherein like reference numerals designate corresponding parts in the various figures. In one embodiment of the invention, the structural components illustrated herein may be considered drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

For a better understanding of embodiments of the present invention as well as other objects and further features thereof, reference is made to the following description which is to be used in conjunction with the accompanying drawings, where.

DETAILED DESCRIPTION OF EXEMPLARY EMBODIMENTS OF THE INVENTION

Figure 1:
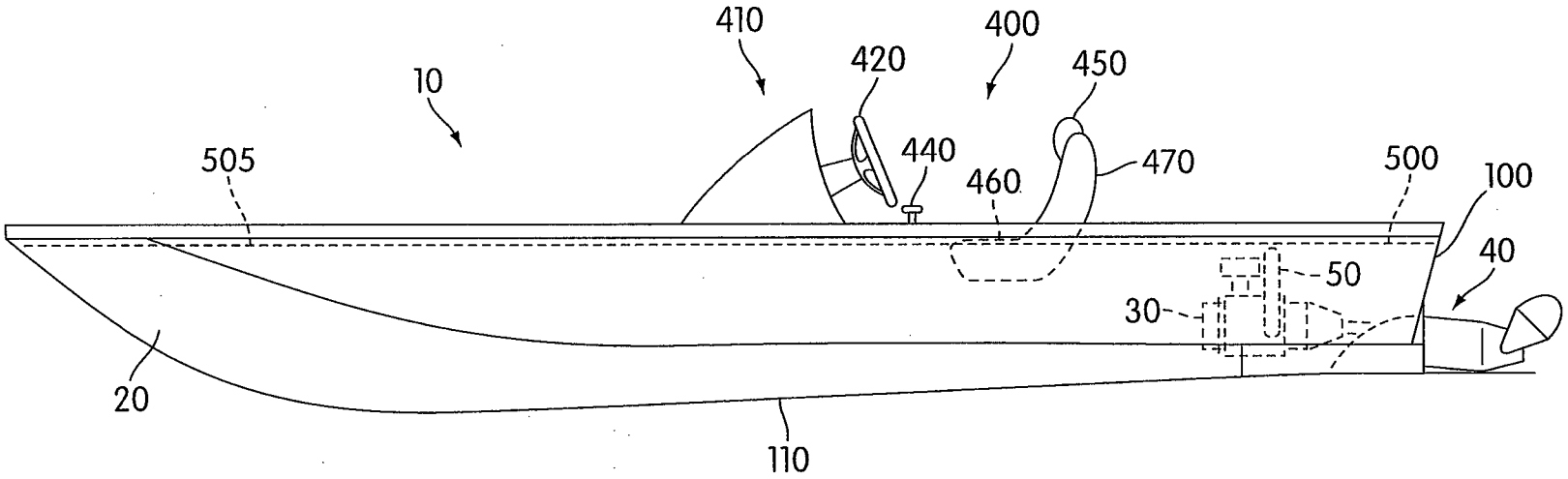
FIG. 1 is a side view of a boat according to an embodiment of the present invention.

FIGS. 1-8 illustrate a boat 10 according to an embodiment of the present invention. The boat 10 comprises a hull 20 (shown in FIG. 1), an inboard engine 30 (shown in FIGS. 1 and 6) supported by the hull 20, a propulsion unit 40 (shown in FIGS. 1 and 6) supported by the hull 20, an exhaust system 50 (shown in FIGS. 1 and 6), a cockpit 400 (shown in FIGS. 1 and 2), seats 450, 480 (shown in FIGS. 1 and 2), and an aft deck 500 (shown in FIG. 2).

According to various embodiments of the invention, the boat 10 comprises a bass boat. The boat may include an electric, outboard trolling motor (not shown) for propelling the boat 10 without using the engine 30.

Figure 3:
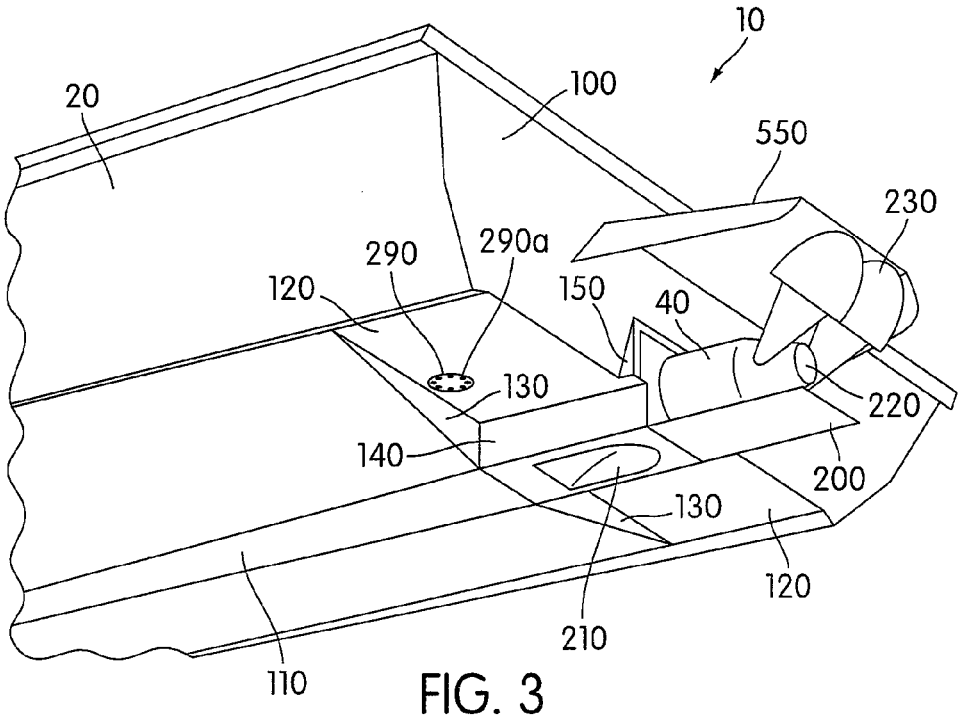
FIG. 3 is a partial bottom perspective view of the boat in FIG. 1.
Figure 4:
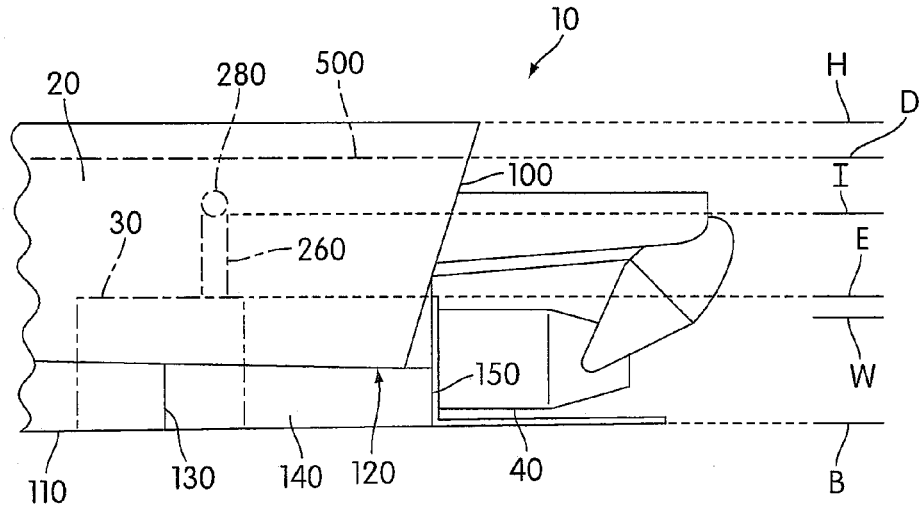
FIG. 4 is an enlarged, partial side view of the boat in FIG. 1.

In the illustrated embodiment, the hull 20 comprises a planing, stepped, hull designed for high-speed planing on lakes, rivers, bays, and other bodies of water. As shown in FIGS. 3 and 4, the hull 20 includes a transom 100, a planing bottom surface 110, a stepped bottom surface 120 that is upwardly offset from the planing bottom surface 110, and a connecting surface 130 extending between the planing bottom surface 110 and the stepped bottom surface 120. The stepped bottom surface 120 is disposed between the planing bottom surface 110 and the transom 100 and extends to the transom 100. the stepped bottom surface 120 may have a longitudinal length of at least 3, 6, 8, 10, 12, 14, 15, 20, 24, 30, 36, or 42 inches. The stepped bottom surface 120 moves the effective center of gravity of the boat 10 rearwardly relative to a water-contacting portion of the planing surface 110, which may improve the boat's high speed maneuverability while planing.

Figure 5:
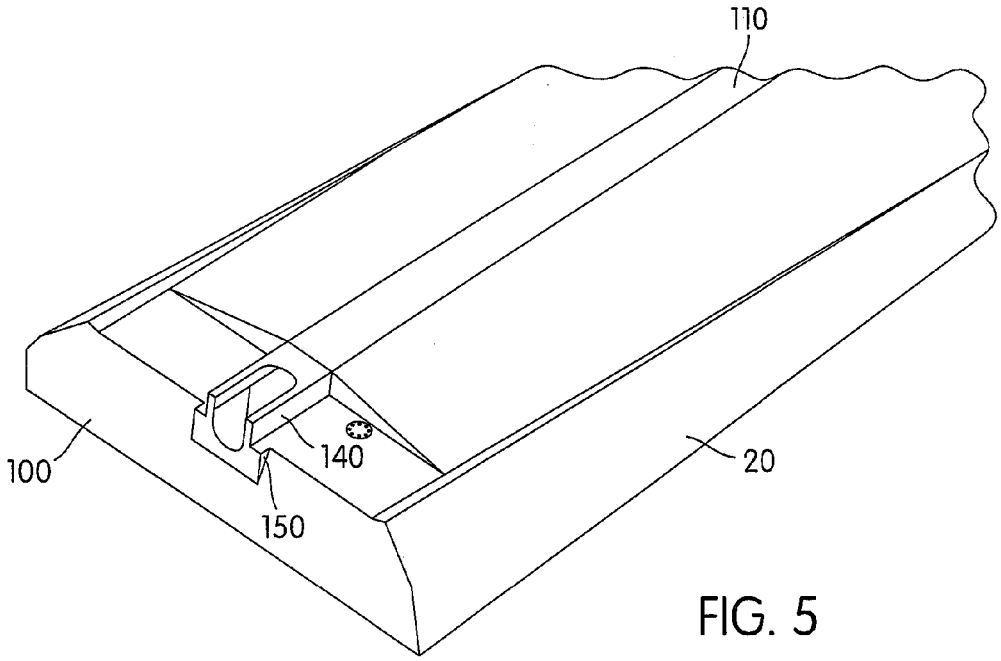
FIG. 5 is a partial perspective bottom view of a hull of the boat in FIG. 1.

As shown in FIGS. 1 and 5, the hull 20 comprises a jet propulsion unit mount 140 that projects downwardly from the stepped bottom surface 120 such that a bottom of the jet propulsion unit mount 140 is vertically aligned with the planing bottom surface 110 (accounting for a thickness of a bottom plate of the jet propulsion unit 40 that may extend downwardly from the mount 140). As illustrated in FIG. 4 an aft end 150 of the mount 140 projects rearwardly from the transom 100 and upwardly from the stepped bottom surface 120.

According to various embodiments, the hull 20 is longer than 10, 12, 14, 15, 16, or 17 feet. According to various embodiments, the hull 20 is shorter than 38, 35, 33, 30, 28, 26, 25, 24, or 23 feet.

Figure 6:
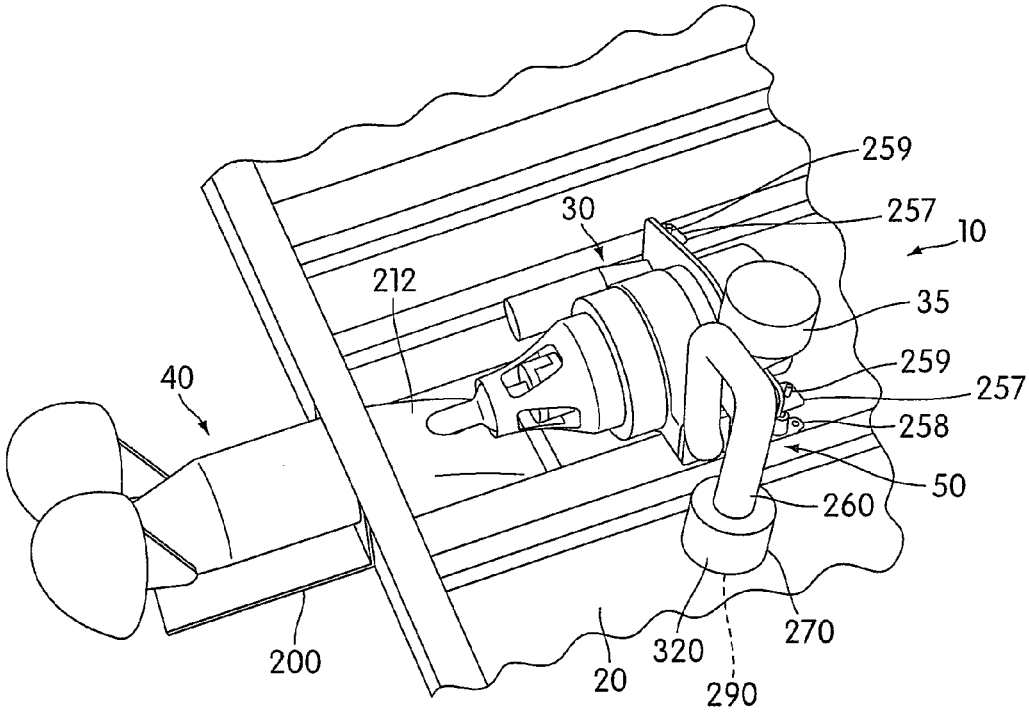
FIG. 6 is a partial top perspective, cut-away view of the hull, engine, and jet propulsion unit of the boat in FIG. 1.

As shown in FIGS. 6 and 7, the inboard engine 30 comprises a rotary engine, although a variety of other types of inboard engines may be used in various embodiments without deviating from the scope of the present invention (e.g., conventional 2 or 4 stroke piston engine). A rotary engine is used in one or more embodiments because it is more compact and lighter than a similar horsepower piston engine. As used herein to describe features and positions of the engine 30, the engine 30 includes the structural components of the engine 30 (e.g., engine body, crank shaft, rotors or pistons, etc.), and does not include components attached to the engine 30 such as the air intake 35, exhaust system 50, electrical wiring, or any other connections between the engine 30 and other components such as throttle cables, fuel lines, coolant lines, etc.).

As shown in FIG. 4, a height E of the uppermost part of the engine 30 is vertically higher than a bottom B (also known as a boat's keel line) of the hull 20 by less than 30, 28, 26, 24, 23, 22, 21, 20, 19, 18, or 16 inches at the longitudinal position of the uppermost part of the engine 30 (i.e., as viewed from the side). The engine 30 may fit inside an engine compartment 512 (see FIG. 2) that is 18 inches high, 18 inches wide, and 18 inches long.

In the illustrated embodiment, the bottom B of the hull 20 also defines an absolute bottom of the boat 10, including the jet propulsion unit 40. However, according to an alternative embodiment, a conventional stern-drive propulsion unit is used in place of the jet propulsion unit 40, and the stern drive unit extends lower than the bottom B of the hull 20.

According to various embodiments, the engine 30 has at least 50, 55, 60, 65, 75, 80, 85, 90, 95, 100, 105, or 110 hp.

An air intake 35 operatively mounts to the engine 30. Although the illustrated rotary engine 30 is a single rotor engine, a multi-rotor rotary engine may alternatively be used without deviating from the scope of the present invention (e.g., a two rotor rotary engine with the rotors longitudinally aligned along the longitudinal direction of the boat 10).

Figure 7A:
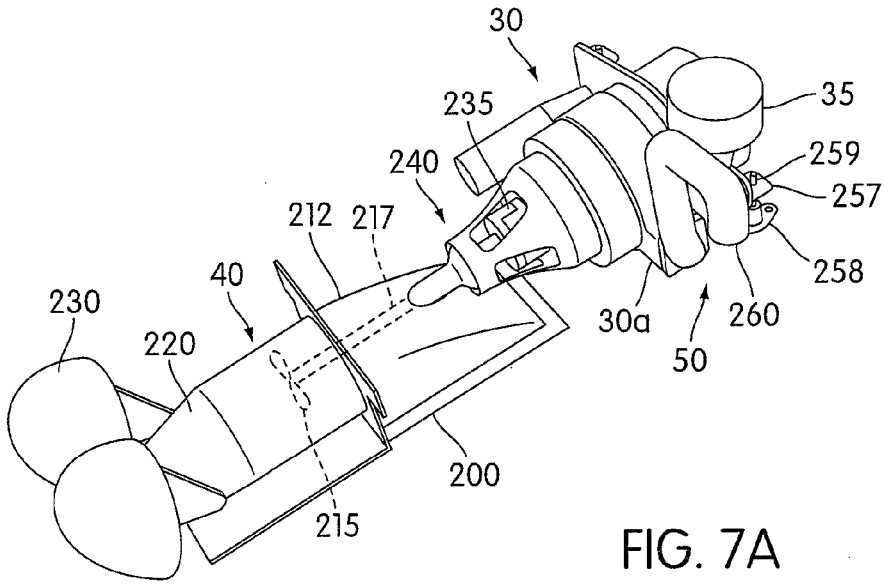
FIG. 7A is a top perspective view of the engine and jet propulsion unit of the boat in FIG. 1.
Figure 7B:
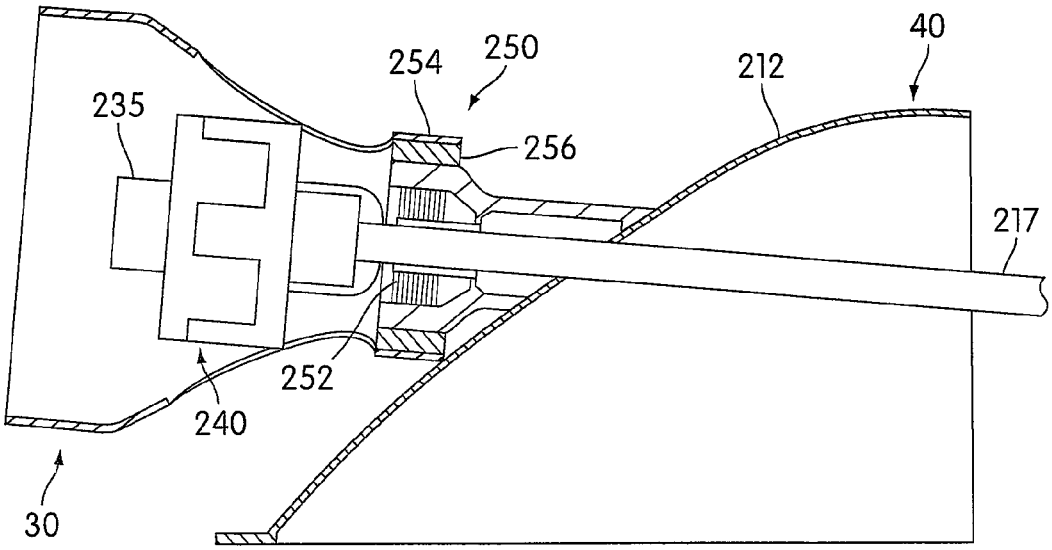
FIG. 7B is a partially cut-away view of the engine and jet propulsion unit connection of the boat in FIG. 1.
Figure 7C:
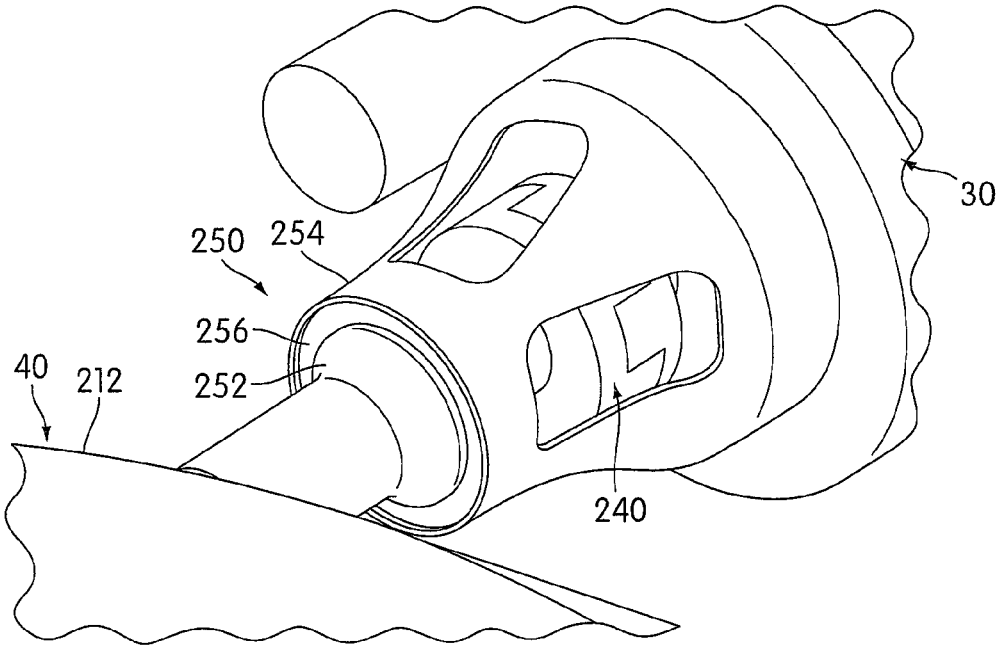
FIG. 7C is a top perspective view of the engine and jet propulsion unit connection of the boat in FIG. 1.
Figure 8:
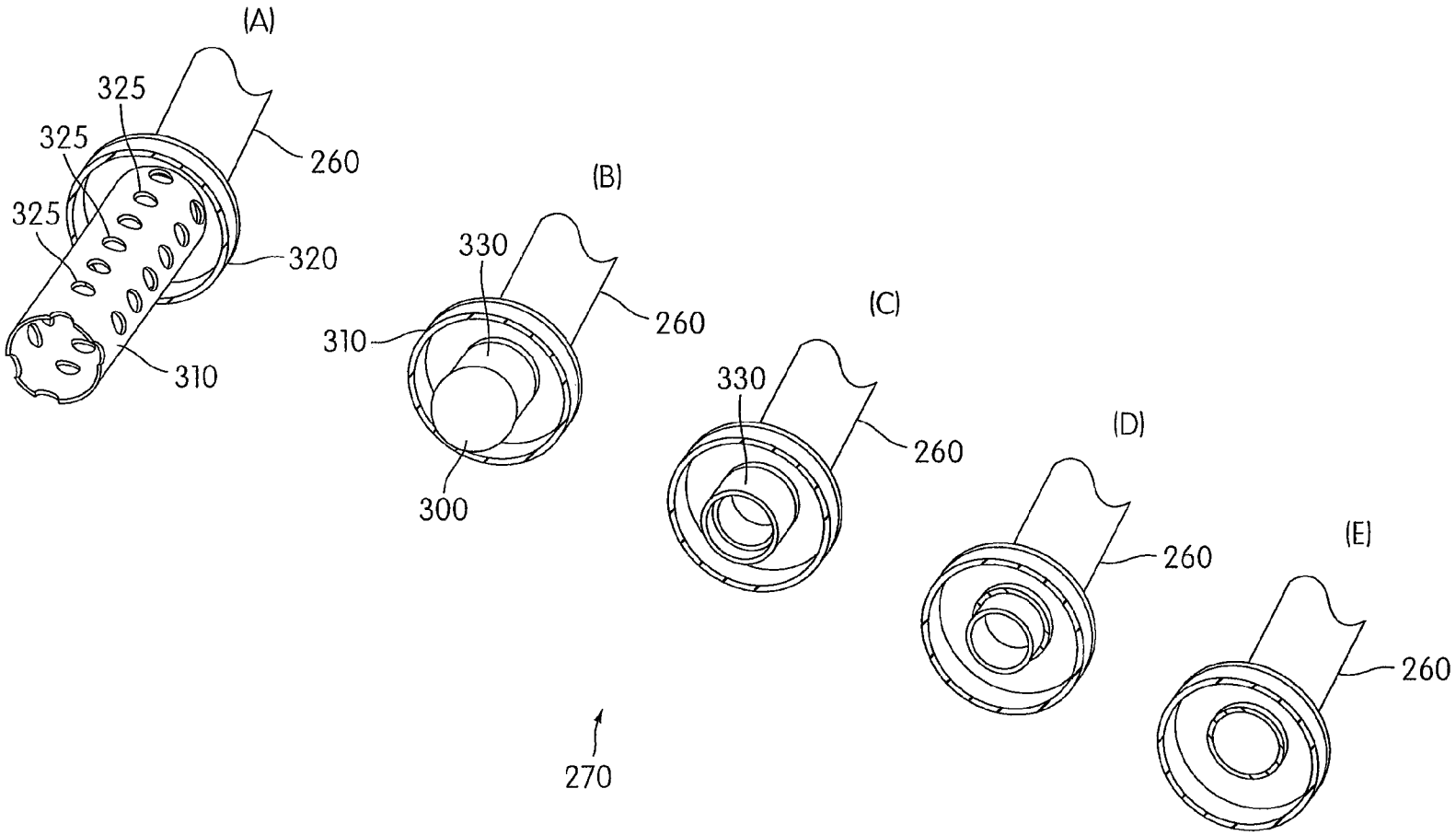
FIGS. 8A-8E are sequentially greater cut-away views of an exhaust valve of the boat in FIG. 1.

As shown in FIGS. 3, 6, and 7, the propulsion unit 40 comprises a jet propulsion unit that includes a lower surface 200 that is flush with the planing surface 110, an intake opening 210 (see FIG. 3) extending upwardly from the surface 200 into a tunnel 212 that is entirely built into the jet propulsion unit 40 (see FIGS. 6 and 7), an impeller 215 (see FIG. 7) in the tunnel 212, an input shaft 217, a nozzle 220, and a reverse deflector 230. As shown in FIGS. 7A-7C, the impeller 215 connects to a drive shaft 235 of the engine 30 via a direct drive connection 240. As shown in FIGS. 7B and 7C, the direct drive connection 240 comprises mating splined ends of the drive shaft 235 and an input shaft 217 of the jet propulsion unit 40. As a result of the direct drive connection 240, the engine's drive shaft 235 rotates at the same speed as the input shaft 217 and impeller 215, and the boat 10 does not utilize a transmission. Although a particular direct drive connection is illustrated, the direct drive connection may comprise any suitable direct drive connection joint (e.g., a straight rigid joint, a gimbaled joint, a CV joint, a break-away joint that would allow the jet propulsion unit to separate from the engine's drive shaft if the jet propulsion unit caught on an obstruction during high speed operation, etc.). According to one or more embodiments, the impeller has a diameter of less than 10, 9, 8, or 7 inches.

As shown in FIG. 3, the jet propulsion unit 40 mounts to the mount 140 of the hull 20 such that a bottom surface of the bottom plate 20 is vertically aligned with the planing bottom surface 110. Such alignment provides for smooth planing and water intake.

Figure 11:
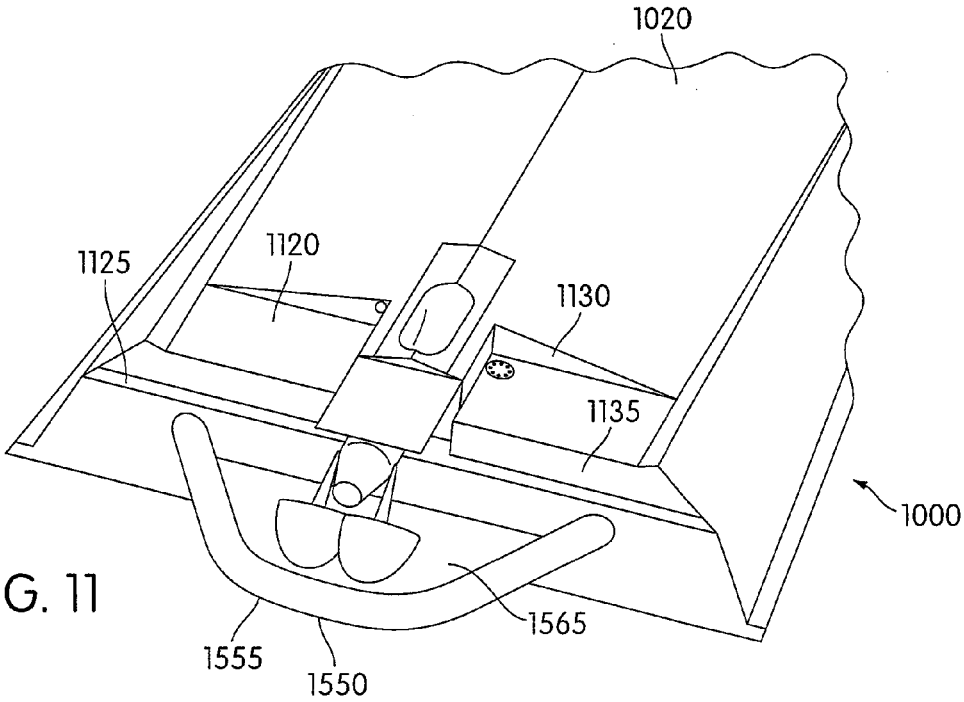
FIG. 11 is a partial, rear, bottom perspective view of the boat in FIG. 9.

As shown in FIG. 3, the water intake opening 210 is disposed entirely rearwardly of the connecting surface 130. Similarly, the water intake opening 210 is longitudinally aligned with the stepped bottom surface 120. However, as shown in FIG. 11, according to an alternative embodiment, the water intake opening may alternatively extend forward of the connecting surface and stepped bottom surface.

Although a particular jet propulsion unit 40 is shown and described, a variety of other suitable types of jet population units may be used instead without deviating from the scope of the present invention. Moreover, a variety of other types of propulsion units 40 may be used without deviating from the scope of the present invention (e.g., conventional propeller or surface drive propeller).

As shown in FIGS. 7B and 7C, the engine 30 mounts to the jet propulsion unit 40 via a self-aligning connection 250. The connection 250 comprises a forward, tapered outer diameter mount 252 attached to, integrally formed with, or otherwise mounted to the jet propulsion unit 40. The connection 250 also comprises an engine mount 254 with a shape that compliments the mount 252 and an inner diameter that increases as it extends rearwardly. The engine mount 254 is attached to, integrally formed with, or otherwise mounted to the engine 30. The connection 250 also comprises an annular elastomeric ring 256 (e.g., rubber) that is disposed between the mounts 252, 254 to help seat the mounts 252, 254 together and to absorb vibrations. The connection 250 is made by sliding the engine 30 rearwardly relative to the jet propulsion unit 40 so that the mount 254 fits over the ring 256 and mount 254. The tapers on the mounts 252, 254 cause this rearward movement to align the engine 30 relative to the jet propulsion unit 40. The movement may also cause the drive shaft 235 to engage the input shaft 217 to form the direct drive connection 240.

In the illustrated embodiment, the mount 252 is a male mount, while the mount 254 is a female mount. The relative positions of the mounts 252, 254 could be reversed without deviating from the scope of the present invention.

In the illustrated embodiment, the mating surfaces of the mounts 252, 254 have circular profiles that align with the axes of the drive shaft 235 and input shaft 217. Alternatively, these surfaces may have any other suitable complimentary shapes/profiles (e.g., tapered oval or rectilinear profiles) without deviating from the scope of the present invention.

As shown in FIGS. 6 and 7, the engine 30 also mounts to the hull 20 via forward port and starboard engine brackets 257 that are welded, attached to, integrally formed with or otherwise mounted to the engine 30. The illustrated brackets 257 include bolt holes. The brackets 257 rest on elastomeric engine mounts 258 that are adjustably mounted to the hull 20. The adjustable mount may comprise elongated slots in the mounts 258 that enable them to be bolted to the hull 20 is a variety of positions. Bolts 259 bolt the brackets 257 to the engine mounts 258. The engine mounts 258 preferably comprise an elastomeric material such as rubber that dampens vibrations.

Together, the self-aligning connection 250 and engine mounts 258 form a 3-point connection between the engine 30 and the remainder of the boat 10. The 3-point connection makes the engine 30 easy to install. First, the connection 250 is formed, which self-aligns the engine 30 relative to the jet propulsion unit 40. The engine 30 is then bolted to the engine mounts 258. The engine 30 may be structurally connected to the hull 20 solely via these 3 points. The structural support for the engine 30 may consist of these three points (i.e., two engine mounts 258 and the self-aligning connection 250).

As shown in FIG. 6, the exhaust system 50 comprises an exhaust pipe 260 and exhaust valve 270 that together define an exhaust passageway 280 (see FIG. 4) for exhausting the engine's exhaust to the environment. As shown in FIG. 7, one end of the exhaust pipe 260 connects to an exhaust outlet 30*a* of the engine 30. The valve 270 is incorporated into a muffler of the exhaust system 50.

As shown in FIG. 3, an exhaust port or outlet 290 is formed in and extends through the stepped bottom surface 120 of the hull. In one embodiment, the exhaust port 290 comprising a ring of circumferentially spaced holes 290*a*, but it may comprise as few as a single hole. The exhaust system 50, and in particular the exhaust valve 270, mounts to the exhaust port 290 so as to vent exhaust downwardly below the stepped bottom portion 120. As shown in FIG. 4, the boat 10 has a static waterline W, that is defined as a level of water when the boat 10 is fully fueled and ready for operation, but is unmanned, not moving, and floating on water. Because the exhaust port 290 (and most or all of the stepped bottom surface 120) is below the waterline W, when the boat 10 is stationary or moving relatively slowly, the exhaust system 50 vents exhaust underwater, which tends to muffle exhaust noise and also advantageously breaks the suction formed by the stepped bottom surface 120 at low speeds. The boat 10 may additionally include air vents that connect the stepped bottom surface 120 to the ambient environment to help break the suction, for example, as is disclosed on U.S. Patent Application Publication No. 2007/0157866, the entire contents of which are hereby incorporated by reference. Conversely, when the boat 10 is planing on the bottom planing surface 110, the exhaust port 290 tends to be out of the water such that the exhaust system 50 vents exhaust into the air, which may avoid some of the back-pressure that underwater exhaust venting causes, while at the same time venting exhaust below the boat 10 to reduce exhaust noise. Avoiding such back-pressure may increase a power of the engine 30 while planing.

While the illustrated embodiment utilizes a single exhaust port 290 offset to one lateral side of the hull 20, the port 290 may be replaced with a dual-exhaust system in which exhaust is divided into two (or more) passageways (e.g., via a T- or Y-joint) that vent through ports 290 in the stepped bottom surface 120 disposed on both lateral sides of the jet propulsion unit 40. Such a multi-port exhaust system may better break the suction at the stepped bottom surface 120 over the width of the bottom surface 120.

According to various embodiments, the boat has a draft of less than 16, 14, 12, or 10 inches. The draft is defined by the height difference between the bottom B and the waterline W. According to one embodiment, the draft is about 10 inches.

As shown in FIGS. 4 and 6, the exhaust system 50 comprises a riser (e.g., an upside down U-shaped portion of the pipe 260) that raises a water ingress height I of the exhaust system 50 (shown in FIG. 4). The water ingress height I is a height of water within the exhaust passageway 280 at which water would backflow into the engine 30. In other words, the water ingress height I is the highest low point within the exhaust passageway 280. As shown in FIG. 4, the height I is defined at the lower surface of the passageway 280 at the top of the riser. The height I is disposed above the waterline W so as to discourage water from backflowing into the engine 30. On the other hand, as explained in greater detail below, the height of the exhaust system 50 is preferably limited according to various embodiments such that the exhaust system 50 does not protrude above an aft deck 500 (described below) of the boat 10. According to various embodiments, the water ingress height I is disposed above the waterline W by less than 13, 12, 11, 10, 9, 8, 7, 6, 5, or 4 inches. Similarly, according to various embodiments, the water ingress height I is disposed above the bottom B by less than 32, 30, 28, 26, 24, 22, 20, 18, or 16 inches. According to one embodiment, the, height I is about 8 inches above the waterline W and about 18 inches above the bottom B.

The exhaust valve 270 is fashioned within the muffler body and is designed to discourage water from entering the engine via the exhaust port 290 and the exhaust system 50. As shown in FIGS. 8A-8E, the valve 270 comprises a floating valve seal 300 disposed in a generally vertically oriented tube 310 that is itself disposed in a larger generally vertically oriented tube 320 (shown in FIG. 6). The tube 320 is larger than the tube 310 such that exhaust gas can pass from the pipe 260 into the tube 310, through holes 325 in the tube 310 into an area between the tubes 310, 320, and finally out of circumferentially spaced holes 290*a* of the exhaust port 290. The seal 300 is smaller than an inner dimension of the tube 310 so that the seal 300 may move up and down within the tube 310. The valve 270 also comprises a downwardly facing valve seat 330 against which the seal 300 can sealingly mate, as shown in FIG. 8B. The floating valve seal 300 is moveable between an upward sealing position (FIG. 8B) and a lower unsealed position, in response to a level of water. The floating valve seal 300 is configured to move into the upward sealing position in response to a water level in the portion of the exhaust passageway 280 rising from the port 290 toward the seat 330, so as to close the valve 270 before water backflows through the seat 330 into the pipe 260. Conversely, when the water height falls or when exhaust pressure pushes downwardly during operation of the engine 30, the seal 300 moves downwardly into its unsealed position, which allows exhaust to vent through the holes 325 and out of the exhaust port 290. A shape of the exhaust port 290 (e.g., a solid portion of the hull 20 that is radially inwardly disposed from the holes 290*a*) and/or a structure at a lower end of the valve 270 prevents the seal 300 from falling out of the valve 270.

In the illustrated embodiment, the seal 300 is a hollow; stainless steel sphere and the tubes 310, 320 are cylindrical. However, a variety of other shapes and materials may be used without deviating from the scope of the present invention (e.g., a cylindrical seal 300; a seal 300 and tubes 310, 320 with corresponding non-circular cross-sections (e.g., square, rectilinear, etc.).

Although the exhaust valve 270 is illustrated as a particular type of valve, a variety of other types of exhaust valves may be used without deviating from the scope of the present invention (e.g., another type of water-height-activated check valve, another type of check valve; etc.).

Figure 2:
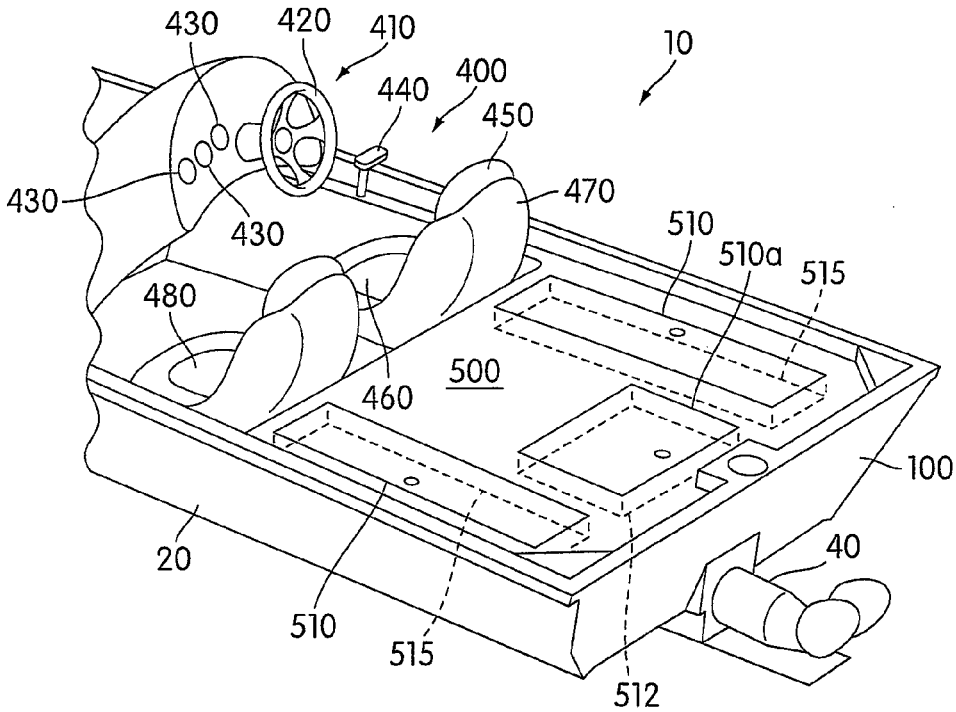
FIG. 2 is a partial top perspective view of the boat in FIG. 1.

As shown in FIGS. 1 and 2, the boat 10 comprises a cockpit 400. The cockpit 400 comprises a console 410 with a steering wheel 420 and a variety of gauges 430 (e.g., tachometer, fuel gauge, depth gauge, fish finder, etc.). The steering wheel 420 is operatively connected to the jet propulsion unit 40 so as to control a direction that water is ejected from the jet propulsion unit 40 so as to steer the boat 10. A throttle controller 440 (e.g., a pivoting throttle lever) is separate from the steering wheel 420 and is operatively connected to the engine 30 to control the engine 30. A reverse switch/lever that raises and lowers the reverse deflector 230 may be incorporated into the throttle controller 440 or may be separate so as to facilitate propelling the boat 10 in reverse and/or establishing a neutral thrust position.

A captain's seat 450 is disposed behind the console 410 to facilitate operation of the boat by a captain sitting in the seat 450. As shown in FIGS. 1 and 2, the seat 450 comprises a bottom portion 460 and an upwardly extending back support 470. The back support 470 may extend at least 12, 14, 16, 18, 20, or 24 inches above a seating surface of the bottom portion 460 and may extend high enough to form a head rest.

As shown in FIG. 2, the console 410 and captain's seat 450 may be laterally offset on the boat 10 and a passenger's seat 480 that is identical to or similar to the captain's seat 450 may be provided in side-by-side arrangement with the captain's seat 450.

As shown in FIG. 2, the aft deck 500 (e.g., fishing platform, swim platform) is substantially flat and extends substantially the whole way across the width of the boat 10 at the longitudinal position of the deck 500. The deck 500 is large, substantially flat, and low so as to provide a convenient deck for people to stand on, sit on, move around on, and fish from.

According to various embodiments, the deck 500 may extend across at least 70%, 80%, or 90% of the width of the hull 20 at the longitudinal position of the deck 500. According to various embodiments, the deck 500 is at least 3, 4, 5, 6, or 7 feet wide (i.e., in a lateral direction of the boat 10). The deck 500 may extend longitudinally from a rear of the seat 450 to the transom 100. According to various embodiments the deck 500 extends longitudinally over at least 70%, 80%, 90%, and or 95% of the fore/aft distance between the back of the seat 450 and the transom 100. According to various embodiments, the deck 500 is at least 2, 3, 4, 5, 6, 7, or 8 feet long in the longitudinal direction. According to various embodiments, the aft deck 500 may merge continuously into other portions of the boat (e.g., providing a continuous deck surface between the aft deck 500 and a fore deck 505 (shown in FIG. 1).

According to one or more embodiments, the deck 500 has an area that is at least 50%, 60%, 70%, 80%, 90%, or 95% of an area disposed rearwardly of a rearwardmost part of the seat 450 and bounded by the port and starboard walls of the hull 20 and the transom 100. According to various embodiments, the area of the deck 500 is at least 10%, 15%, 20%, 25%, 30%, or 35% of a total deck area of the entire boat 10. According to various embodiments, the area of the deck 500 is at least 10%, 15%, 20%, 25%, 30%, or 35% of a total area of the boat 10 as vertically projected onto a horizontal plane. According to various embodiments, the area of the deck 500 is at least 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, or 36 square feet.

As shown in FIG. 4, a height D of the deck 500 extends above the waterline W by less than 18, 15, 14, 13, 12, 11, 10, 9, 8, 7, 6, or 5 inches. Similarly, according to various embodiments, the height D extends above the bottom B by less than 32, 30, 28, 26, 25, 24, 23, 22, 21, 20, 19, 18, or 17 inches. According to one or more embodiments, the entire deck 500 is vertically separated from the bottom B of the hull 20 by less than 33, 32, 30, 28, 26, 24, 22, 20, or 18 inches at any longitudinal point along the deck 500 (e.g., as viewed from the side). According to one embodiment, the height D is about 12 inches above the waterline W and about 22 inches above the bottom B.

According to various embodiments, the height D of the deck 500 does not deviate by more than 1, 1.5, or 2 inches over the course of a foot in any direction such that the deck 500 is substantially planar and level. However, larger height changes may occur at intersections between the deck 500 and other decks (e.g., a deck beside the seats 450, 480). Thus, according to various embodiments, a height deviation of greater than 1, 1.5, or 2 inches over the course of a foot identifies a border of the deck 500 and a transition into another deck or feature of the boat 10.

As shown in FIG. 1, the deck 500 is disposed above the engine 30 and exhaust system 50. According to one or more embodiments, the deck 500 extends continuously over the engine 30 and exhaust system 50 and that the engine 30 and exhaust system 50 do not protrude through the deck 500 surface. According to one or more embodiments, the engine 30 and/or exhaust system 50 are disposed entirely lower than the deck height H. According to various embodiments, no portion of the engine 30 or exhaust system 50 extends vertically higher than the deck height H. According to various embodiments, no portion of the engine 30 or exhaust system 50 extends higher than the top edge H of the hull 20 as viewed from the side. According to one or more embodiments, the engine 30 and/or exhaust system 50 are positioned entirely underneath the deck 50 (i.e., falling entirely within a vertically projected outer perimeter of the deck 500).

The use of a rotary engine as the engine 30 may provide more power in a smaller engine than a comparable piston engine. Thus, according to one or more embodiments, the rotary engine 30 may not require as large (or high) an engine compartment as would be required if a conventional piston engine were used. Thus, while cowlings for conventional piston engines on bass boats have extended above an aft deck and the hull, the rotary engine 30 according to one or more embodiments may be disposed entirely below the deck 500 and/or hull 20 so as to provide a larger, flatter aft deck 500. The use of the exhaust valve 270 in combination with a lower riser in the exhaust system 50 may likewise facilitate disposing the exhaust system 50 entirely below the deck 500 and/or hull 20, again avoiding any need to obstruct the deck 500 by having an exhaust pipe's riser extend up above the deck according to one or more embodiments.

As shown in FIG. 2, the deck 500 may be defined, in part, by various flush-mount lids 510 that provide access to below-deck areas of the boat 10 when open and form part of the deck 500 when closed (e.g., a flush-mount engine lid 510*a* that provides access to an engine compartment 512 containing the engine 30, compartments (e.g., livewell, storage, rod holders, etc.). Such lids 510 may be entirely removable and simply fit into correspondingly shaped recesses. Alternatively and/or additionally, lids 510 may be hinged to the rest of the deck 500. As shown in FIG. 2, compartments 515 are disposed on both lateral sides of the engine 30 and engine compartment 512.

Various unobtrusive openings may be formed in the deck 500. For example, a hole (e.g., having a 1, 2, or 3 inch diameter) may be formed in the deck 500 to facilitate insertion of a correspondingly sized base rod of a removable swivel chair that extends upwardly from the deck 500.

As shown in FIG. 4, the hull 20 extends above the deck 500 by a small distance. According to various embodiments, a top edge H of the lateral sides of the hull 20 and transom 100 (i.e., the sides and back of the boat 10) do not extend vertically higher than the deck height D (i.e., the surface thereof) by more than 12, 10, 8, 7, 6, 5, 4, 3, 2, 1, or 0 inches at any longitudinal position of the deck 500 (i.e., as viewed from the side as shown in FIG. 4). According to various embodiments, the deck 500 is actually higher than adjacent parts of the hull (e.g., the transom or upper sides of the hull) such that the deck 500 slopes or drops downwardly to the hull.

As shown in FIG. 3, a jet propulsion unit guard 550 extends rearwardly from the transom 100. As shown in FIG. 3 the guard 550 comprises a plate that is bent downwardly at the lateral sides to provide strength. The guard 550 may be strong enough to support the weight of a person, thereby defining an additional deck/swim platform. The guard 550 may be designed to discourage fishing lines from catching on the jet propulsion unit 40. The guard 550 may also be designed to protect the jet propulsion unit 40, keep down spray from the jet propulsion unit 40, provide a place to stand or kneel, and/or keep fishing/ski tow lines away from the jet propulsion unit 40.

Figure 9:
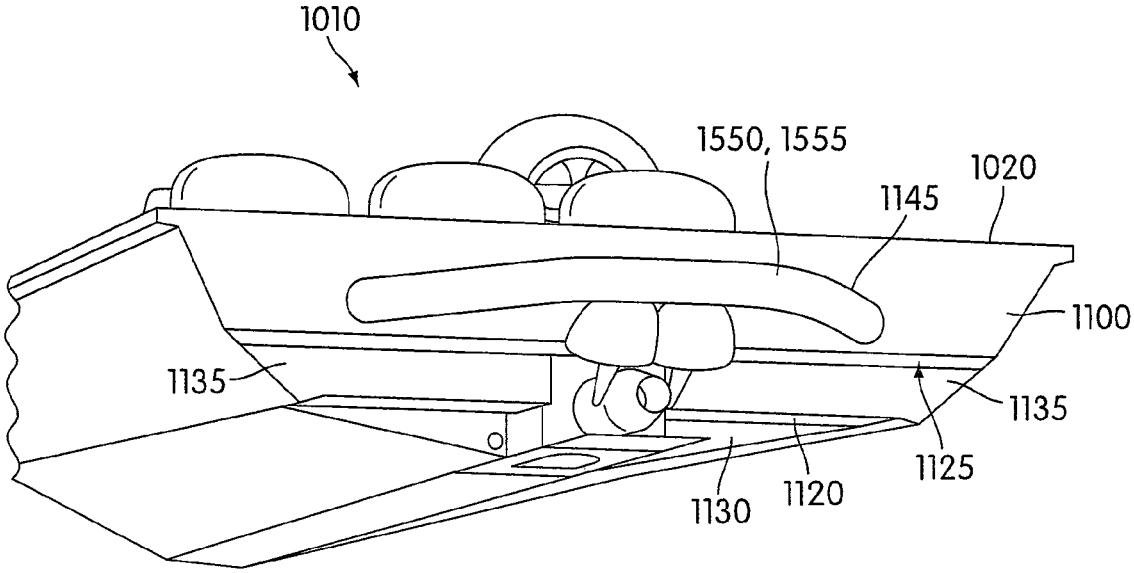
FIG. 9 is a rear perspective view of a boat according to an alternative embodiment of the present invention.
Figure 10:
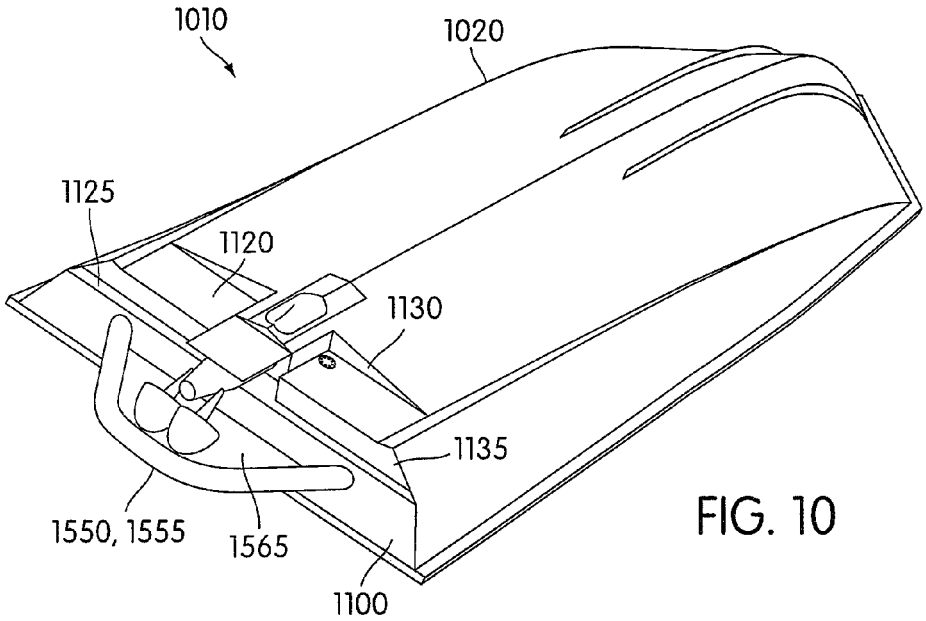
FIG. 10 is a rear, bottom perspective view of the boat in FIG. 9.

FIGS. 9-11 illustrate a boat 1010 according to an alternative embodiment of the present invention. The boat 1010 is generally similar to the boat 10. Accordingly, a redundant description of redundant features is omitted, and identical reference numbers (plus 1000) are used for such redundant features). A hull 1020 of the boat 1010 includes a secondary stepped bottom surface 1125 that is upwardly offset from a first stepped bottom surface 1120. The secondary stepped bottom surface 1125 is longitudinally disposed between the first stepped bottom surface 1120 and the transom 1100. A second connecting surface 1135 extends between the first stepped bottom surface 1120 and the second stepped bottom surface 1125.

A propulsion unit guard 1550 extends rearwardly from the transom 1100. In this embodiment, the propulsion unit guard 1550 comprises a horizontally-oriented generally C, U, or V shaped tube 1555 with a plate 1565 mounted thereon to provide a fishing/swim platform.

Figure 12:
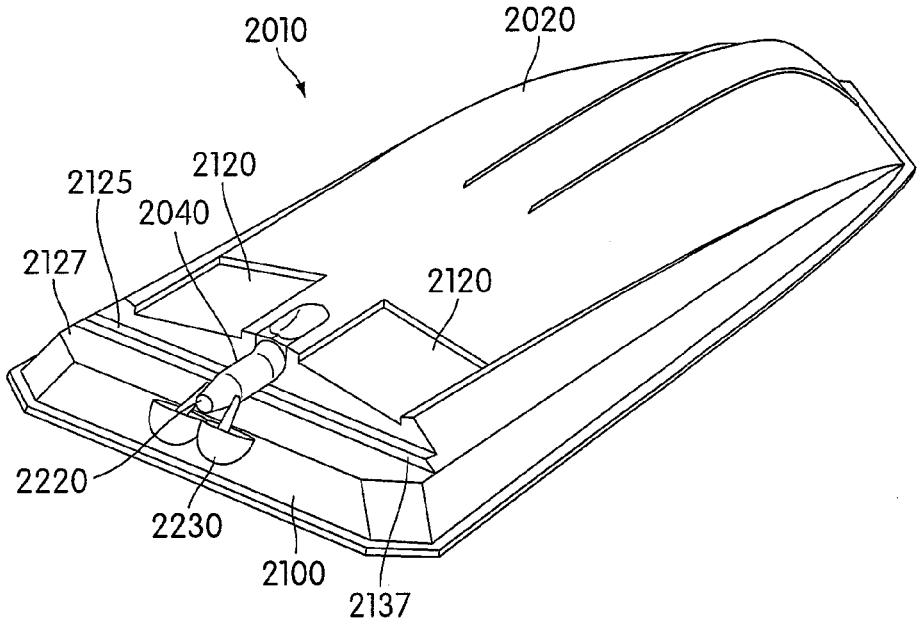
FIG. 12 is rear, bottom perspective view of a boat according to an alternative embodiment of the present invention.

FIG. 12 illustrates a boat 2010 according to an alternative embodiment of the present invention. The boat 2010 is generally similar to the boat 1010. Accordingly, a redundant description of redundant features is omitted, and identical reference numbers (plus 1000) are used for such redundant features). The shape of the stepped bottom surface 2120 of the hull 2010 differs from the shape of the stepped bottom surface 1120 of the hull 1020 in that the stepped bottom surface 2120 is generally parallel to the planing bottom surface 2110 (as opposed to the substantially horizontal stepped bottom surface 1120).

As shown in FIG. 12, the hull 2010 also includes a third stepped bottom surface 2127 that is upwardly offset from the second stepped bottom surface 2125. A third connecting surface 2137 extends between the second stepped bottom surface 2125 and the third stepped bottom surface 2127. The transom 2100 extends upwardly from the third stepped bottom surface 2127. Thus, the third stepped bottom surface 2127 and transom 2100 substantially project over the jet propulsion unit 2040 and protect the jet propulsion unit 2040, effectively extending the length of the hull 2020 rearwardly over the jet propulsion unit 2040. According to one or more embodiments, a back edge of the transom extends rearwardly more than a nozzle 2220 and/or reverse deflector 2230 of the jet propulsion unit 2040.

According to an alternative embodiment, the second and third stepped bottom surfaces 2125, 2127 are merged into a single second stepped bottom surface and the connecting surface 2137 omitted.

Figure 16:
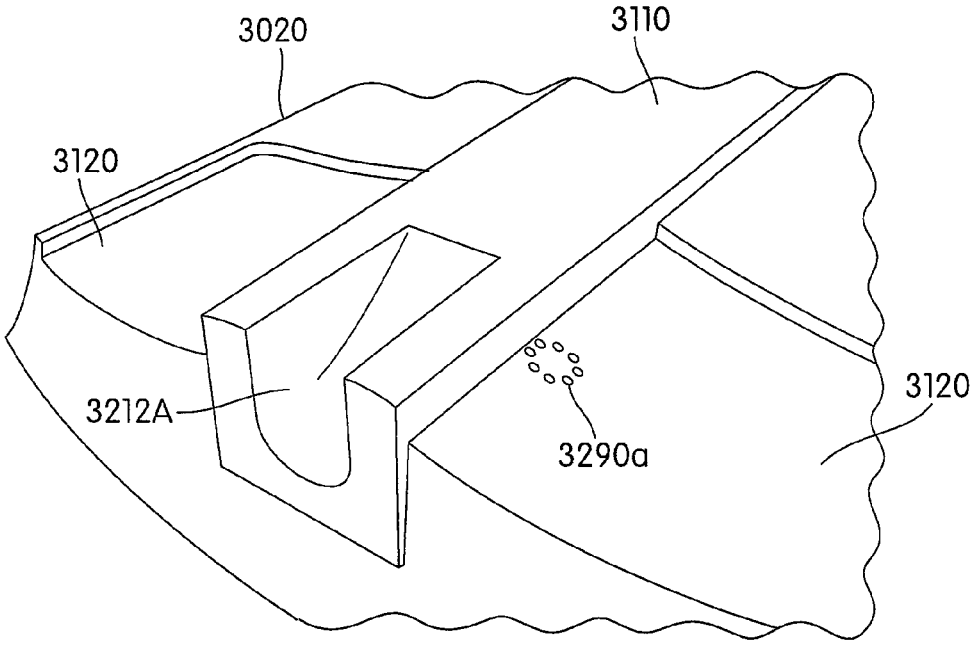
FIG. 16 is a partial perspective bottom view of the hull of the boat in FIG. 13.
Figure 17:
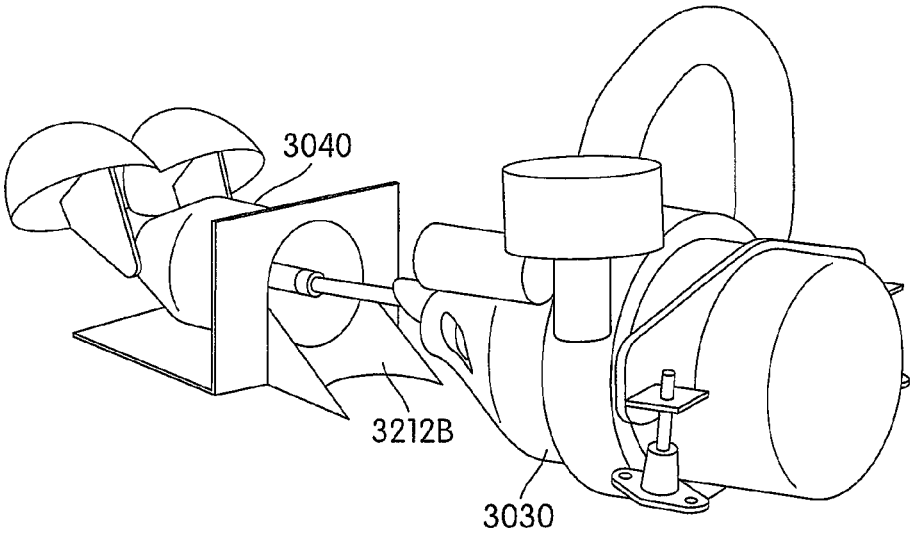
FIG. 17 is top perspective view of the engine and jet propulsion unit of the boat in FIG. 13.

FIGS. 13-17 illustrate a boat 3010 according to an alternative embodiment of the present invention. The boat 3010 is generally similar to the boat 10. Accordingly, a redundant description of redundant features is omitted, and identical reference numbers (plus 3000) are used for such redundant features). As shown in FIG. 16, the stepped bottom surface 3120 is upwardly offset from and generally parallel to the planing bottom surface 3110.

Figure 13:
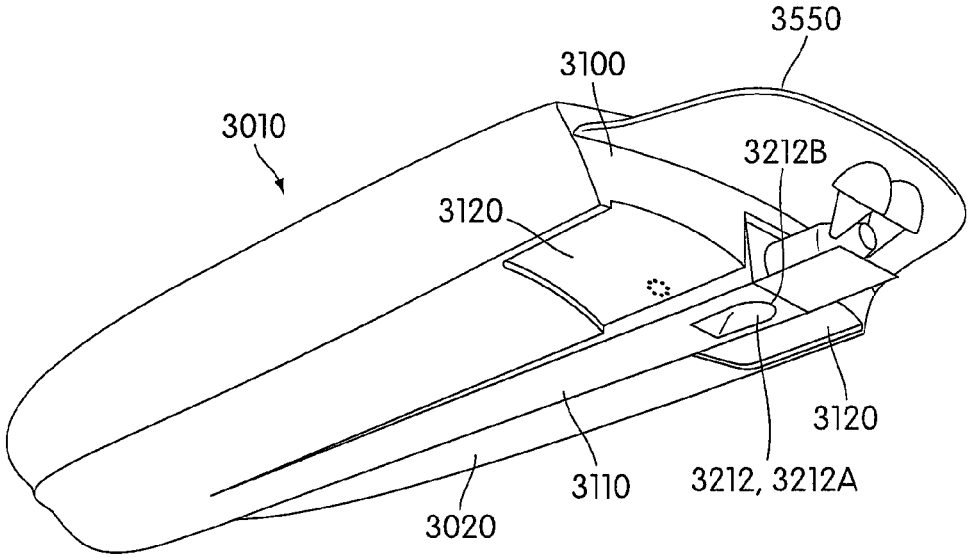
FIG. 13 is rear, bottom perspective view of a boat according to an alternative embodiment of the present invention.
Figure 14:
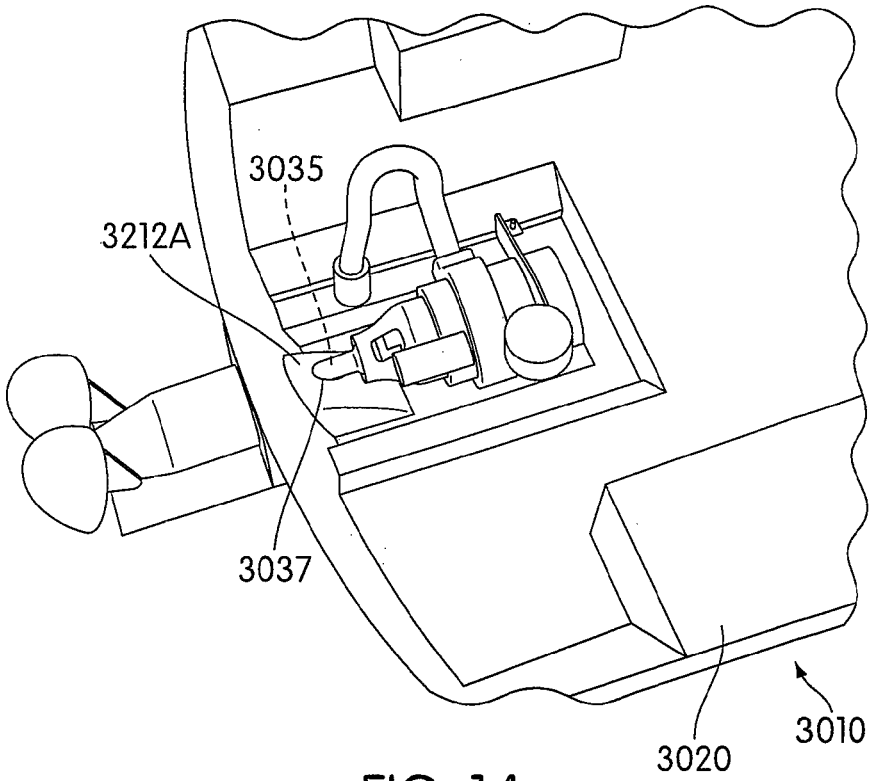
FIG. 14 is a partial top perspective, cut-away view of the hull, engine, and jet propulsion unit of the boat in FIG. 13.
Figure 15:
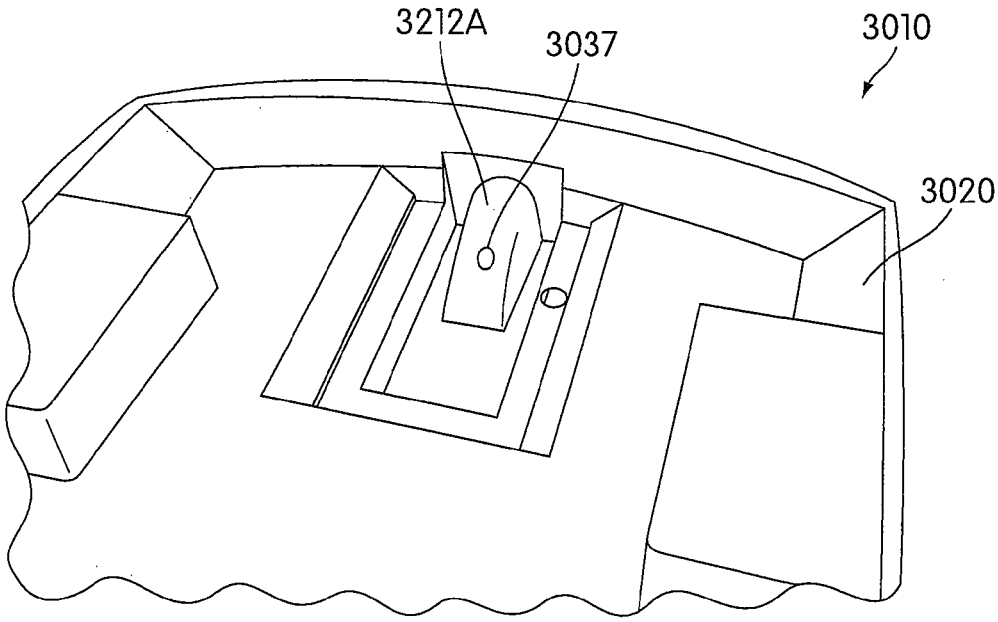
FIG. 15 is a partial perspective top view of a hull of the boat in FIG. 13

As shown in FIGS. 13-16, a tunnel 3212 for the jet propulsion unit 3040 is partially formed by a tunnel portion 3212A of the hull 5020 and partially formed by a tunnel portion 3212B of the jet propulsion unit 3040. As shown in FIG. 14, a driveshaft 3035 extends from the engine 3030 to the jet propulsion unit 3040 through a hole 3037 formed in the tunnel portion 3212A of the hull 3020. According to various embodiments, a larger or smaller amount of the tunnel and/or jet intake may be formed by the hull, as opposed to a separate portion of the jet propulsion unit. In fact, according to various embodiments, the entire tunnel may be formed by the hull (e.g., for some fiberglass hulls, but also possible with some metal or rotationally molded plastic hulls) or by the separate jet propulsion unit.

As shown in FIG. 13, an enlarged swim platform/fishing platform 3550 extends rearwardly from a transom 3100 of the boat 3010. The entire jet propulsion unit 3040 (including the reverse deflectors thereof) are preferably disposed entirely underneath the rest of the boat 3010 (e.g., the hull 3010 and swim platform 3550).

FIGS. 18-23 illustrate a boat 4010 according to an alternative embodiment of the present invention. The boat 4010 is generally similar to the above-discussed boats 10, 1010, 2010, 3010, except that the boat 4010 is a run-about 4010, as opposed to a bass boat 10, 1010, 2010, 3010. Accordingly, a redundant description of redundant features is omitted, and identical reference numbers (in the 4xxx range) are used for such redundant features. The boat 4010 comprises a hull 4020, an inboard engine 4030 (shown in FIG. 23) supported by the hull 4020, a propulsion unit 4040 (shown in FIG. 23) supported by the hull 4020, an exhaust system 4050 (shown in FIG. 23), a cockpit 4400 (shown in FIGS. 1 and 2), seats 4450, 4480 (shown in FIGS. 20 and 21), and an aft deck/swim platform/fishing deck 4500 (shown in FIG. 2).

The hull 4020 may be similar to or identical to any of the hulls of the above-discussed boats 10, 1010, 2010, 3010. The illustrated hull 4020 is similar to the hull 3020. According to various embodiments, the hull 4020 is longer than 10, 12, 14, 15, 16, or 17 feet. According to various embodiments, the hull 4020 is shorter than 30, 28, 26, 25, 24, or 23 feet.

The engine 4030 and propulsion unit 4040 may be similar to or identical to the engine 30 and propulsion unit 40 or the engine and propulsion units of the other above-discussed boats 10, 1010, 2010, 3010. The engine 4030, jet propulsion unit 4040, and exhaust system 4050 may be positioned relative to the rest of the boat 4010 (e.g., bottom B, deck 4500) in the same or similar manner as the engine 30, propulsion unit 40, and exhaust system 50 are positioned relative to comparable components of the boat 10.

The aft deck/swim platform 4500 may positioned in the same or similar position as the deck 500. The deck 4500 is large, substantially flat, and low so as to provide a convenient deck for people to stand on, sit on, move around on, and fish from. Moreover, because the deck 4500 is low, it is easier for a swimmer to get up onto the deck 4500 from the water than with conventional runabouts that have higher aft decks.

Figure 19:
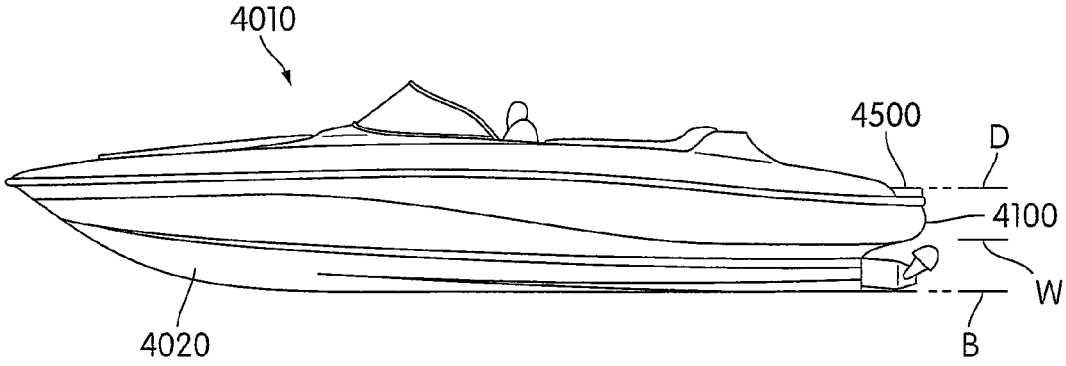
FIG. 19 is a side view of the boat in FIG. 18.

According to various embodiments, the deck 4500 may extend across at least 70%, 80%, or 90% of the width of the hull 4020 at the longitudinal position of the deck 4500. According to various embodiments, the deck 4500 is at least 3, 4, 5, 6, or 7 feet wide (i.e., in a lateral direction of the boat 4010). As shown in FIG. 19, the deck 4500 may extend longitudinally the whole way to and over the transom 4100, such that the deck 4500 is higher than or flush with the transom, which may make it easier for a swimmer in the water to board the boat 4010 via the deck 4500. According to various embodiments, the deck 4500 is at least 2, 3, 4, 5, 6, 7, or 8 feet long in the longitudinal direction.

According to various embodiments, an area of the deck 4500 is at least 10%, 15%, 20%, 25%, 30%, or 35% of a total deck area of the entire boat 4010. According to various embodiments, the area of the deck 4500 is at least 10%, 15%, 20%, 25%, 30%, or 35% of a total area of the boat 10 as vertically projected onto a horizontal plane. According to various embodiments, the area of the deck 4500 is at least 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, or 36 square feet.

As shown in FIG. 19, a height D of the deck 4500 extends above a waterline W by less than 18, 15, 14, 13, 12, 11, 10, 9, 8, 7, 6, or 5 inches. Similarly, according to various embodiments, the height D of the deck 4500 extends above a bottom B of the hull 4020 by less than 32, 30, 28, 26, 25, 24, 23, 22, 21, 20, 19, 18, or 17 inches. According to one or more embodiments, the entire deck 4500 is vertically separated from the bottom B of the hull 4020 by less than 33, 32, 30, 28, 26, 24, 22, 20, or 18 inches at any longitudinal point along the deck 4500 (e.g., as viewed from the side). According to one embodiment, the height D of the deck 4500 is about 12 inches above the waterline W and about 22 inches above the bottom B.

Figure 23:
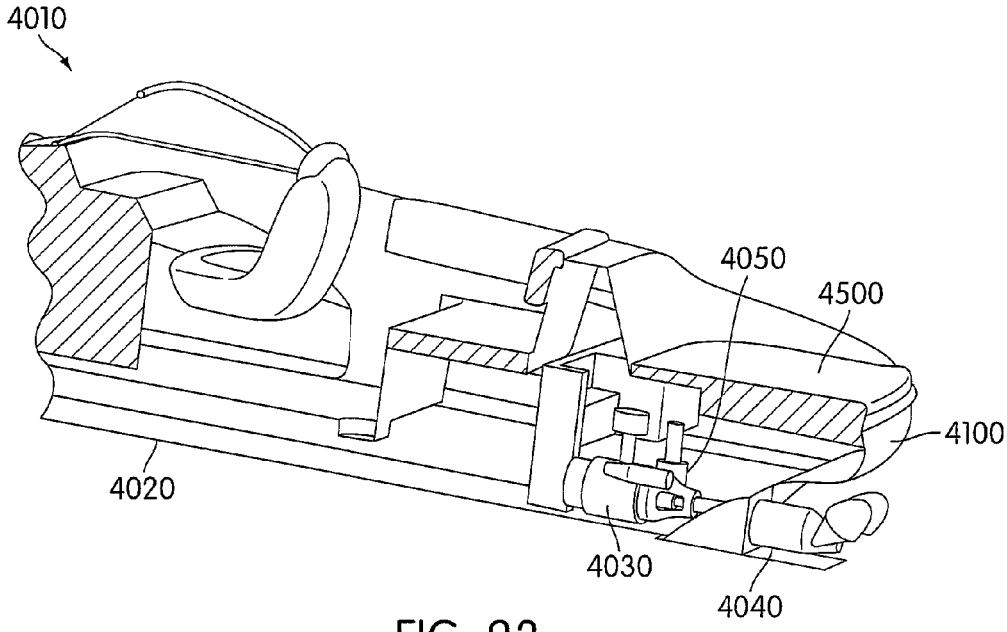
FIG. 23 is a cut-away side view of the boat in FIG. 18.

As shown in FIG. 23, the engine 4030 and exhaust system 4050 are disposed entirely lower than the deck 4500. The engine 4030 may extend farther forward than the deck 4500.

Figure 18:
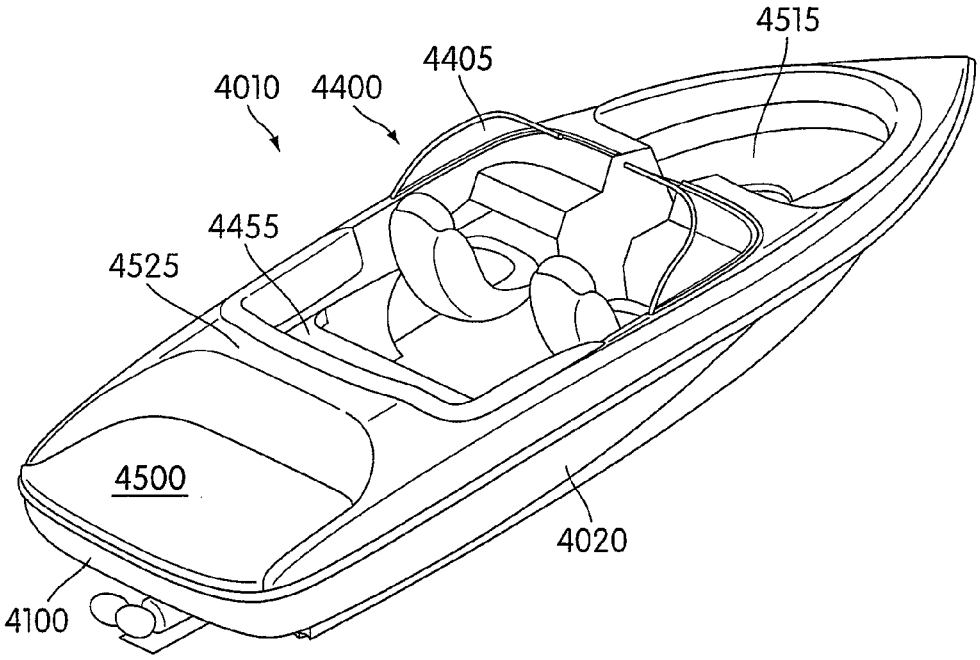
FIG. 18 is a top perspective view of a boat according to an alternative embodiment of the present invention.
Figure 20:
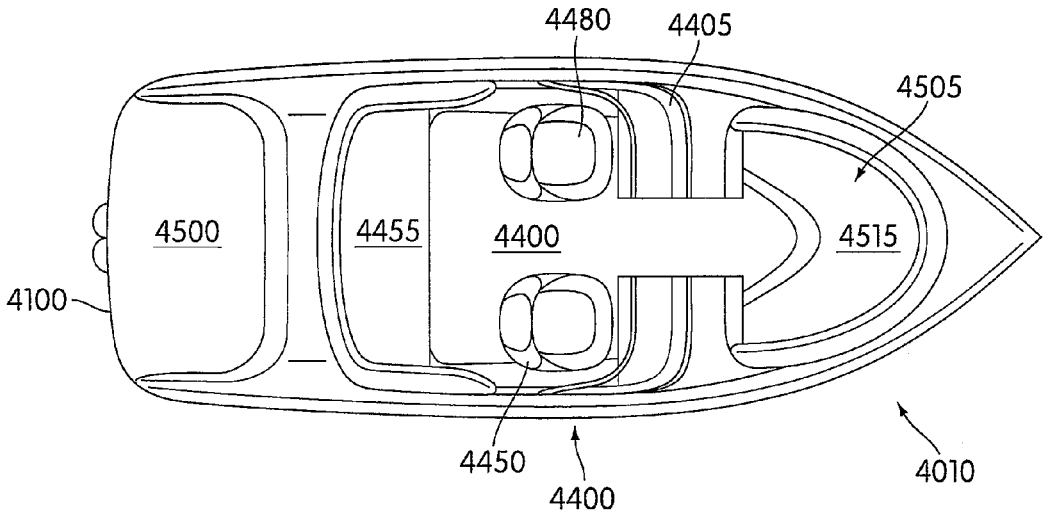
FIG. 20 is a top view of the boat in FIG. 18.
Figure 21:
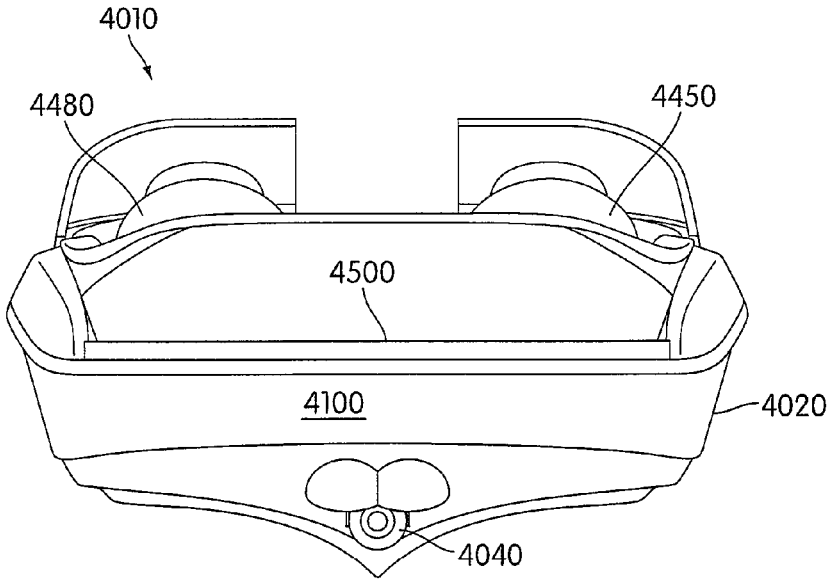
FIG. 21 is a rear view of the boat in FIG. 18.
Figure 22:
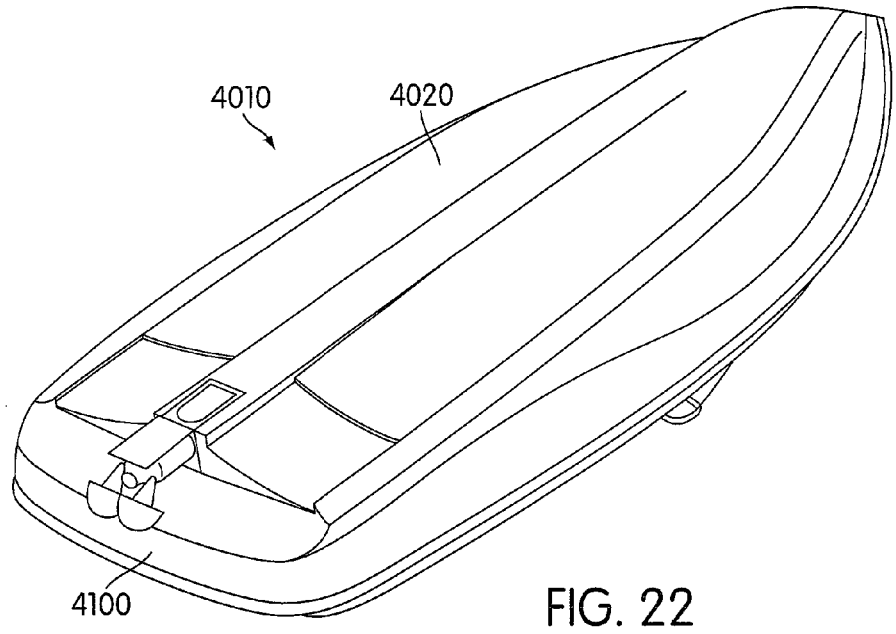
FIG. 22 is a bottom perspective view of the boat in FIG. 18.

As shown in FIGS. 18 and 20, a wraparound windshield 4405 protects the cockpit 4400, and can be opened in the middle to provide access to a fore deck 4505 with seat 4515 that wraps around the bow of the boat 4010. A bench seat 4455 is provided behind the side-by-side seats 4450, 4480 in the cockpit 4400.

Because the engine 4030 and exhaust system 4050 are so low, the deck layout of the boat 4010 can be easily modified to accommodate different designs. For example, an upwardly extending wall 4525 between the deck 4500 and bench seat 4455 may be moved forward, backward, or eliminated altogether. According to one embodiment, the wall 4455 is pushed rearwardly far enough that the bottom seating surface of the bench seat 4455 is disposed over the engine 4030, thereby providing an enlarged cockpit area. The wall 4525 may fold flat so as to join the bench seat 4455 and deck 4500 into a continuous, substantially flat deck with an enlarged area.

The boats 10, 4010 illustrate how aspects of various embodiments of the invention can be incorporated into two example types of boats, bass boats and runabouts. However, one or more embodiments of the present invention may be incorporated into different types of boats without deviating from the scope of the present invention. For example, the engine 30, propulsion unit 40, and exhaust system 50 may be incorporated into a pontoon boat in which the engine 30, jet propulsion unit 40, and exhaust system 50 are all disposed entirely below the main deck of the pontoon boat.

Unless otherwise specifically stated, the vertical direction and vertical distances are measured perpendicular to the bottom B of the hull 20. As used herein, the longitudinal direction means the fore/aft direction of the boat 10. The lateral direction means the port/starboard direction. The term "as viewed from the side" means as viewed in the port/starboard direction perpendicular to the longitudinal direction (as shown in FIG. 4).

As used herein, the term "about" means within 10% of for example, "about 10 inches" means between 9 and 11 inches.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed is:

1. A boat comprising:

a stepped hull that includes:

a transom, a planing bottom surface, a stepped bottom surface that is upwardly offset from the planing bottom surface, the stepped bottom surface being disposed between the planing bottom surface and the transom, wherein a rearward portion of the planing bottom surface is disposed between lateral portions of the stepped bottom surface such that the lateral portions of the stepped bottom surface step upwardly from the rearward portion of the planning bottom surface as the hull progresses laterally outwardly from the rearward portion, and a connecting surface extending between the planing bottom surface and the stepped bottom surface;

an inboard engine supported by the hull, the engine having a drive shaft;

a jet propulsion unit supported by the hull, the jet propulsion unit having an inlet that is at least partially disposed (1) on the rearward portion of the planning bottom surface, and (2) forwardly of the transom; and a drive connection between the drive shaft and the jet propulsion unit.

2. The boat of claim 1, further comprising:

an exhaust port extending through one of the lateral portions of the stepped bottom surface;

an exhaust passageway fluidly connecting an exhaust outlet of the engine to the exhaust port; and a floating valve seal in a portion of the exhaust passageway that extends at least partially vertically, the floating valve seal being moveable between an upward sealing position and a lower unsealed position, the floating valve seal being configured to move into the upward sealing position in response to a water level in the portion of the exhaust passageway rising, the floating valve seal discouraging water from entering the engine via the exhaust port when the floating valve seal is in the upward sealing position, the floating valve seal sealing the exhaust outlet of the engine from the external environment when in the upward sealing position.

3. The boat of claim 1, wherein the hull is at least 14 feet long.

4. The boat of claim 3, wherein:

the exhaust passageway has a water ingress height defined as a height of water within the exhaust passageway at which water would backflow into the engine; and the water ingress height is less than 30 inches above a bottom of the hull.

5. The boat of claim 4, wherein the water ingress height is less than 25 inches above the bottom of the hull.

6. The boat of claim 3, wherein:

the boat has a waterline defined when the boat is fully fueled and ready for operation, but is unmanned;

the exhaust passageway has a water ingress height defined as a height of water within the exhaust passageway at which water would backflow into the engine; and the water ingress height is less than 11 inches above the waterline.

7. The boat of claim 1, wherein the boat comprises a cockpit having a steering wheel and separate throttle controller.

8. The boat of claim 1, wherein the boat comprises side-by-side seats.

9. The boat of claim 1, wherein:

the inboard engine comprises an inboard rotary engine; and the drive connection between the drive shaft and the jet propulsion unit comprises a direct drive connection.

10. The boat of claim 9, wherein the engine does not connect to the jet propulsion unit via a transmission.

11. The boat of claim 1, wherein the stepped bottom surface is configured such that at least a portion of the stepped bottom surface does not contact water when the boat is planning on the planning bottom surface.

12. The boat of claim 1, further comprising:

an exhaust port extending through one of the lateral portions of the stepped bottom surface; and an exhaust passageway fluidly connecting an exhaust outlet of the engine to the exhaust port.

13. A boat comprising:

a hull;

an inboard engine supported by the hull, the engine having a drive shaft;

a jet propulsion unit supported by the hull; and a drive connection between the drive shaft and the jet propulsion unit;

an exhaust port extending through the hull to an outer surface of the hull that is below a waterline of the boat defined when the boat is fully fueled and ready for operation, but is unmanned;

an exhaust passageway fluidly connecting an exhaust outlet of the engine to the exhaust port; and a floating valve seal in a portion of the exhaust passageway that extends at least partially vertically, the floating valve seal being moveable between an upward sealing position and a lower unsealed position, the floating valve seal being configured to move into the upward sealing position in response to a water level in the portion of the exhaust passageway rising, the floating valve seal discouraging water from entering the engine via the exhaust port when the floating valve seal is in the upward sealing position, the floating valve seal sealing the exhaust outlet of the engine from the external environment when in the upward sealing position.

14. The boat of claim 13, wherein:

the inboard engine comprises an inboard rotary engine; and the drive connection between the drive shaft and the jet propulsion unit comprises a direct drive connection.

15. The boat of claim 13, further comprising side-by-side seats.

16. The boat of claim 13, wherein the hull is at least 14 feet long.

17. A boat comprising:

a stepped hull having a transom, a planing bottom surface, a stepped bottom surface that is upwardly offset from the planing bottom surface, the stepped bottom surface being disposed between the planing bottom surface and the transom, and a connecting surface extending between the planing bottom surface and the stepped bottom surface;

an inboard rotary engine supported by the hull;

a jet propulsion unit supported by the hull and operatively connected to the engine to propel the boat when driven by the engine, wherein the jet propulsion unit comprises an intake portion that projects downwardly from the stepped bottom surface such that a bottom of the intake portion is vertically aligned with the planing bottom surface and lateral portions of the stepped bottom surface are disposed on each lateral side of the intake portion such that the lateral portions of the stepped bottom surface step upwardly from the intake portion as the hull progresses laterally outwardly from the intake portion to the lateral portions of the stepped bottom surface; and an exhaust port extending through one of the lateral portions of the stepped bottom surface; and an exhaust passageway fluidly connecting an exhaust outlet of the engine to the exhaust port.

18. The boat of claim 17, wherein:

the hull comprises a jet propulsion unit mount that projects downwardly from the stepped bottom surface such that a bottom of the jet propulsion unit mount is vertically aligned with the planing bottom surface; and the jet propulsion unit is mounted to the jet propulsion unit mount.

19. The boat of claim 18, wherein a portion of the jet propulsion unit mount projects rearwardly from the transom.

20. The boat of claim 17, wherein the hull is longer than 12 feet and shorter than 30 feet.

21. The boat of claim 17, wherein the boat comprises a cockpit having a steering wheel and a throttle controller separate from the steering wheel.

22. The boat of claim 17, wherein the boat comprises a cockpit having a steering wheel and a seat adapted for use by a person driving the boat, the seat having a bottom portion and an upwardly extending back support.

23. The boat of claim 17, wherein the boat comprises side-by-side seats.

24. The boat of claim 17, wherein the hull extends rearwardly farther than any part of the jet propulsion unit.

25. The boat of claim 17, further comprising a check valve in the exhaust passageway, the check valve being oriented so as to discourage water from entering the engine via the exhaust port.

* * * * *